US012643030B2

(12) United States Patent
Hillary

(10) Patent No.: US 12,643,030 B2
(45) Date of Patent: Jun. 2, 2026

(54) BASKETBALL REBOUNDING APPARATUS

(71) Applicant: Greg Hillary, Chubbuck, ID (US)

(72) Inventor: Greg Hillary, Chubbuck, ID (US)

( * ) Notice: Subject to any disclaimer, the term of this patent is extended or adjusted under 35 U.S.C. 154(b) by 393 days.

(21) Appl. No.: 18/408,920

(22) Filed: Jan. 10, 2024

(65) Prior Publication Data

US 2024/0157215 A1 May 16, 2024

Related U.S. Application Data

(63) Continuation-in-part of application No. 18/233,449, filed on Aug. 14, 2023, now Pat. No. 11,904,219.

(60) Provisional application No. 63/405,529, filed on Sep. 12, 2022.

(51) Int. Cl.

| | |
|---|---|
| ***A63B 69/00*** | (2006.01) |
| ***A63B 63/08*** | (2006.01) |
| *A63B 63/00* | (2006.01) |

(52) U.S. Cl.

CPC ..... *A63B 69/0071* (2013.01); *A63B 63/083* (2013.01); *A63B 2063/001* (2013.01); *A63B 2210/50* (2013.01)

(58) Field of Classification Search

CPC ..... A63B 69/0071; A63B 63/083; A63B 2063/001

USPC ..... 473/433

See application file for complete search history.

(56) References Cited

U.S. PATENT DOCUMENTS

| | | | | | |
|---|---|---|---|---|---|
| 5,098,090 | A * | 3/1992 | Juhl | A63B 63/083 | 473/433 |
| 5,348,290 | A * | 9/1994 | Matherne | A63B 63/083 | 473/433 |
| 5,746,668 | A * | 5/1998 | Ochs | A63B 63/083 | 473/433 |
| 5,803,837 | A * | 9/1998 | LoFaso, Sr. | A63B 69/0071 | 473/448 |
| 6,302,811 | B1 * | 10/2001 | Topham | A63B 63/083 | 473/483 |
| 7,393,293 | B2 * | 7/2008 | Guerzini | A63B 63/083 | 473/483 |
| 7,841,957 | B1 * | 11/2010 | Wares | A63B 69/0071 | 473/433 |
| 8,128,517 | B2 * | 3/2012 | Blair | A63B 63/083 | 473/433 |
| 9,873,030 | B2 * | 1/2018 | Frostino | A63B 47/00 | |
| 10,080,944 | B1 * | 9/2018 | Bowling | A63B 63/083 | |
| 11,904,219 | B1 * | 2/2024 | Hillary | A63B 69/0071 | |
| 2005/0192126 | A1 * | 9/2005 | Remaklus | A63B 63/083 | 473/448 |
| 2008/0305896 | A1 * | 12/2008 | McAllister | A63B 63/083 | 473/483 |
| 2009/0203472 | A1 * | 8/2009 | Snyder | A63B 63/083 | 473/433 |

(Continued)

*Primary Examiner* — Mitra Aryanpour

(57) ABSTRACT

The basketball rebounding apparatus includes a first frame having a first arm and a second arm. The first and second arms lead to a second frame. The second frame may be hingedly coupled to the first and second arms, thereby the second frame may descend away from the first and second arms. The basketball rebounding apparatus may have a spring that controls the second frame. When a basketball passes through a basketball hoop and the basketball rebounding apparatus, it will travel towards the second frame via the first and second arms. Once the basketball contacts the second frame, it will be in a stationary position until removed by a user.

20 Claims, 28 Drawing Sheets

(56) References Cited

U.S. PATENT DOCUMENTS

| | | | | |
|---|---|---|---|---|
| 2021/0362021 | A1* | 11/2021 | Reed | A63B 71/023 |
| 2023/0241471 | A1* | 8/2023 | Reed | A63B 63/083<br>473/483 |

* cited by examiner

BASKETBALL REBOUNDING APPARATUS

CROSS-REFERENCE TO RELATED APPLICATIONS

This application is a continuation-in-part of U.S. Non-Provisional patent application Ser. No. 18/233,449 filed on Aug. 14, 2023, which claims the benefit of U.S. Provisional Application Ser. No. 63/405,529, filed on Sep. 12, 2022, both of which are incorporated herein by reference.

TECHNICAL FIELD

The present disclosure relates to a basketball rebounding apparatus. More particularly, the present disclosure relates to an adjustable rebounding apparatus that can be used for all ages.

BACKGROUND

Basketball has been around since the late 1800s. Since then, it has become an international sensation and an integral part of American culture that affects the lives of both young and old. The game has evolved over the years in the equipment used, such as the basketballs and basketball hoops, and training has changed dramatically. There have been many companies focused on developing training equipment to make a basketball player quicker and stronger so as to get the most out of the player. Some of the training equipment found on the market includes passing machines, weighted gloves, and shooting aids. Training for a basketball player is essential to develop a player's skills.

One aspect of training that is essential to a player being successful at all levels of play and on both ends of the court (defensive and offensive ends) is rebounding the basketball. There are numerous training drills to help a player develop rebounding skills. These drills may include timing and jumping, box out techniques, and reaction rebounding, to name a few. A lot of these drills require the help of a coach or teammates to perform them properly. At times, it is not feasible to practice with a coach or a team. Furthermore, a lot of these drills do not teach strength, timing, or jumping skills that are needed to rebound a basketball properly. Some of these drills are also difficult to learn and to practice.

Accordingly, there is a need for an apparatus that can be used alone or with others, increases a player's strength, timing, and jumping skills, and is easy to use. The present invention seeks to solve these and other problems.

SUMMARY OF EXAMPLE EMBODIMENTS

In one embodiment, a basketball rebounding apparatus comprises a first frame with a first arm and a second arm coupled thereto. The first frame may be cylindrical and rest upon an upper surface of a basketball rim. The first frame may comprise an aperture that allows a basketball to pass therethrough. The first frame may comprise a plurality of first fasteners so as to allow the first frame to couple to the basketball rim.

The first and second arms may couple to a bottom surface of the first frame via, for example, welding, nuts and bolts, or any other type of coupling mechanism. In particular, a first end of the first and second arms may couple to the first frame. Further, a second end of the first and second arms may receive a second frame that is hingedly coupled thereto with a second fastener. The second frame may further comprise a support member that may be coupled to a lower surface of the second frame, thereby adding additional support. The support member may include a first bracket coupled thereto. It will be appreciated that the second frame can hold a basketball in place so that a user can pull it from the second frame. That is, after a user shoots the basketball and it goes in the basketball hoop, the basketball will pass through until stopping on the second frame, where it will stay until removed by a user.

The basketball rebounding apparatus further includes a cage coupled thereto that retains a basketball after a user shoots the ball into the basketball hoop. The cage may comprise a first cage member, a second cage member, a third cage member, and a fourth cage member. The fourth cage member may comprise a second bracket that descends below the fourth cage member.

In addition, a pneumatic spring may control the motion of the second frame. That is, when a user places a certain amount of pressure on the pneumatic spring, the second frame may lower, thereby releasing a basketball to the user.

In one embodiment, an adjustable basketball hoop comprises a back panel (i.e., backboard), a rim, a first shaft positionable into a second, larger shaft and the first and second shafts positionable into a third shaft that is larger than both the first and second shafts. With the shafts positionable one inside the other, the adjustable basketball hoop can be raised or lowered to numerous heights. The adjustable basketball hoop further comprises a base with a first support arm and a second support arm hingedly coupled to the third shaft. In addition, the third shaft is coupled to the base via a bracket comprising a first sidewall and a second sidewall. It will be appreciated that the third shaft may be hingedly coupled to the bracket so that the third shaft may fold and contact the base. Once against the base, the adjustable basketball hoop may be easily transported.

In one embodiment, a basketball rebounding apparatus comprises a first frame removably attachable to a first arm and a second arm. The first frame may comprise a plurality of first fasteners so as to allow the first frame to couple to a basketball rim. The first fasteners may comprise a first finger and a second finger at a first end, with a channel interposed between the first and second fingers. When the first fasteners are in position, the first frame 302 may be coupled to the basketball rim. Furthermore, the first frame may comprise a first receiving member and a second receiving member. The first and second receiving members may be configured to receive the first and second arms and be removably attachable.

A second end of the first and second arms may receive a second frame that is hingedly coupled thereto. The basketball rebounding apparatus further includes a cage that retains a basketball after a user shoots the ball into the basketball hoop. The cage may comprise a first cage member, a second cage member, a third cage member, and a fourth cage member. The first cage member may couple to the first and second arms via a first, curved coupler on the first arm and a second, curved coupler on the second arm. In addition, a spring may control the motion of the second frame.

Once the basketball rebounding apparatus is coupled to the rim of the basketball hoop, a user may shoot the basketball through the basketball hoop so as to position the basketball on the second frame, the second frame being in a first, resting position. At that point, a user may jump up and pull the basketball down, thereby activating the spring to release the basketball, moving the second frame to a second, release position. After the basketball is removed, the second frame via the spring may automatically reset to the first position, ready to receive another basketball.

DETAILED DESCRIPTION OF EXAMPLE EMBODIMENTS

Figure 1:
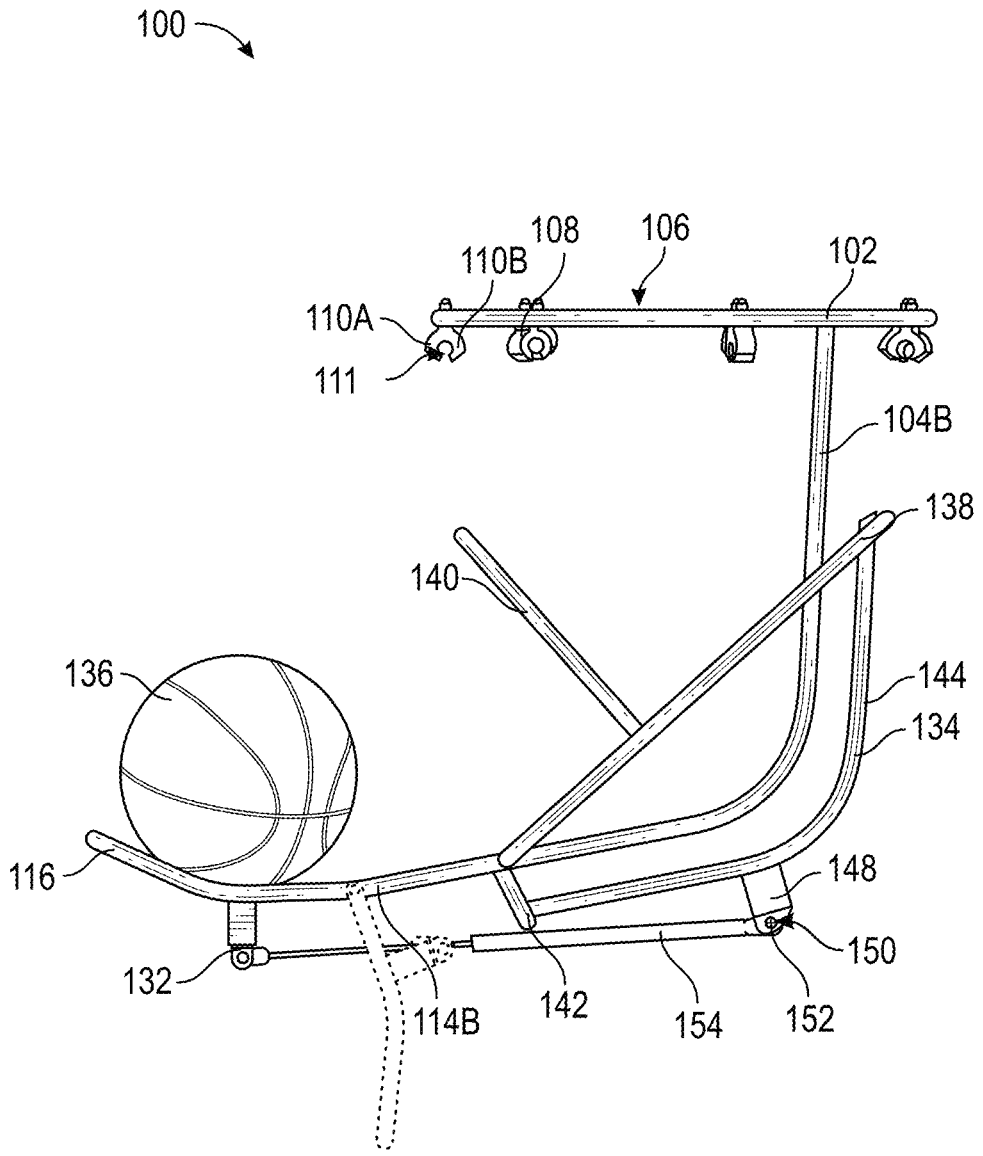
FIG. 1 illustrates a side elevation view of a basketball rebounding apparatus.
Figure 2:
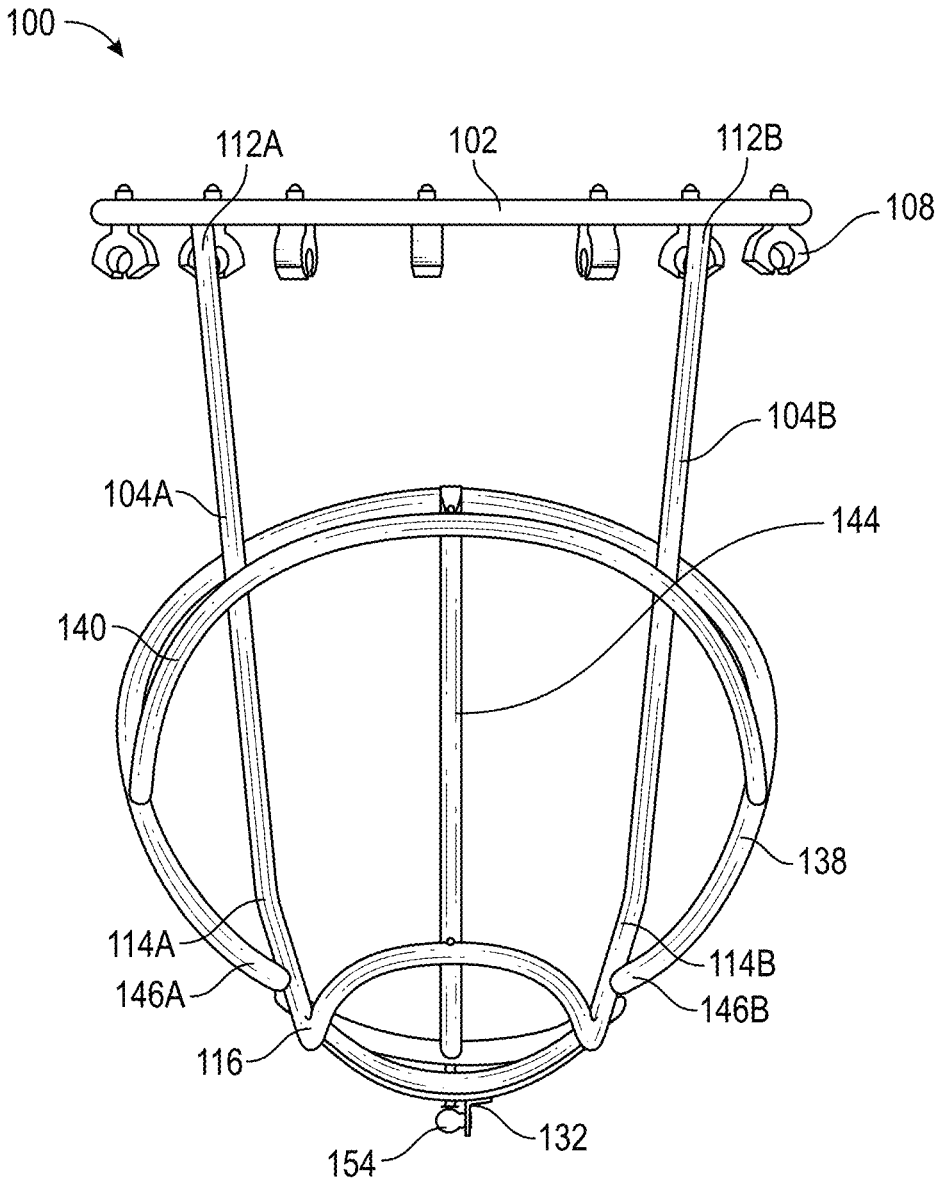
FIG. 2 illustrates a front elevation view of a basketball rebounding apparatus.
Figure 3:
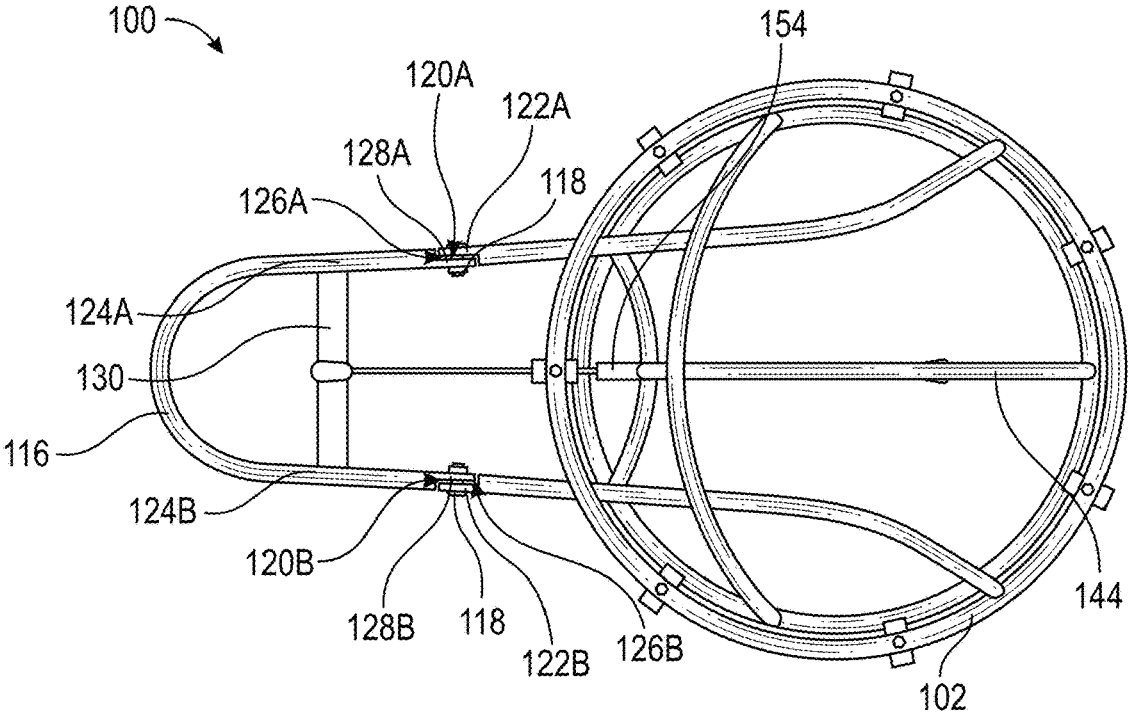
FIG. 3 illustrates a top plan view of a basketball rebounding apparatus.
Figure 4:
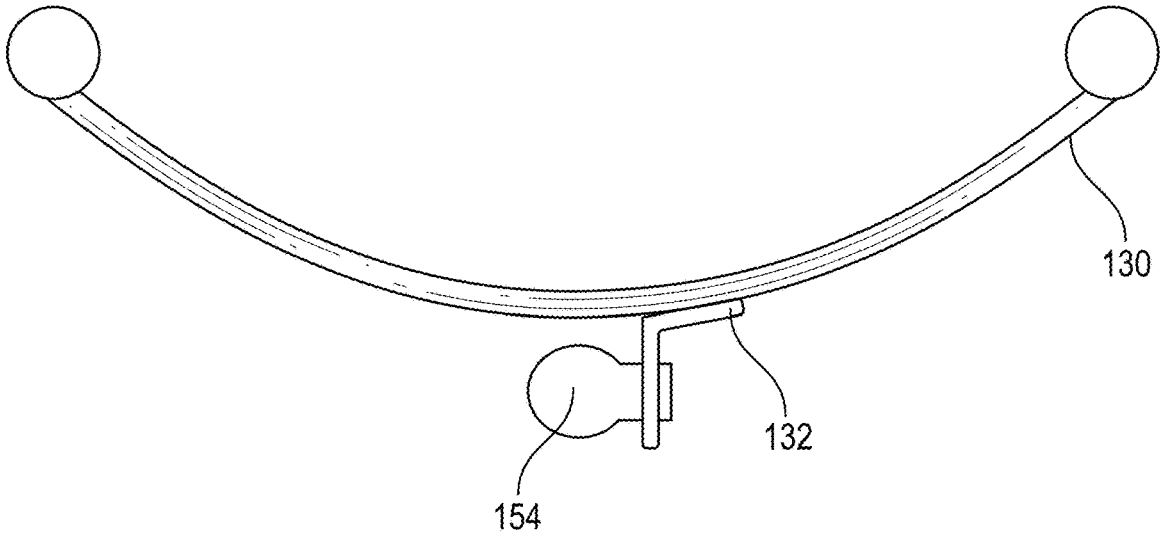
FIG. 4 illustrates a support member and a first bracket of a basketball rebounding apparatus.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed. Rather, the present disclosure will cover all modifications, equivalents, and alternatives falling within the scope of the present disclosure.

Reference to the invention, the present disclosure, or the like are not intended to restrict or limit the invention, the present disclosure, or the like to exact features or steps of any one or more of the exemplary embodiments disclosed herein. References to "one embodiment," "an embodiment," "alternate embodiments," "some embodiments," and the like, may indicate that the embodiment(s) so described may include a particular feature, structure, or characteristic, but not every embodiment necessarily includes the particular feature, structure, or characteristic.

Any arrangements herein are meant to be illustrative and do not limit the invention's scope. Although specific terms are employed herein, they are used in a generic and descriptive sense only and not for purposes of limitation. Unless otherwise defined herein, such terms are intended to be given their ordinary meaning not inconsistent with that applicable in the relevant industry and without restriction to any specific embodiment hereinafter described.

It will be understood that the steps of any such processes or methods are not limited to being carried out in any particular sequence, arrangement, or with any particular graphics or interface. In fact, the steps of the disclosed processes or methods generally may be carried out in various, different sequences and arrangements while still being in the scope of the present invention. Certain terms are used herein, such as "comprising" and "including," and similar terms are meant to be "open" and not "closed" terms. These terms should be understood as, for example, "including, but not limited to."

As previously described, there is a need for an apparatus that can be used alone or with others, increases a player's strength, timing, and jumping skills, and is easy to use. The present invention seeks to solve these and other problems.

Basketball is an important part of American culture and is played by children, youth and adults throughout the country. Not only is basketball important for some as a recreational activity, it is also important for many who attempt to make a living from it. As such, training and developing basketball skills is essential. An essential skill that all basketball players need, is that of rebounding the basketball. To develop this skill, requires hours and hours of work. A part of developing this skill is increasing strength and coordination (e.g., timing). Many rebound trainings have been developed. However, some of these are difficult to learn, especially without a coach. In addition, multiple trainings may be needed to develop both strength and timing.

The basketball rebounding apparatus described herein comprises a first frame including a first arm and a second arm that leads to a second frame. The second frame may be hingedly coupled to the first and second arms, thereby allowing the second frame to descend away from the first and second arms. The basketball rebounding apparatus may also comprise a spring that controls the second frame. In particular, when a basketball passes through the basketball hoop and the basketball rebounding apparatus, it will travel towards the second frame via the first and second arms. Once the basketball contacts the second frame, it will be in a stationary position until removed by a user. To remove the basketball, a user would have to jump up and grab the basketball, pulling it down with enough force to release the tension in the spring until the basketball is free. It will be appreciated that the basketball rebounding apparatus may increase strength and timing of a user. It will further be appreciated that the basketball rebounding apparatus may be removably attachable. Thus, it may be transported from one basketball hoop to another.

Figure 5:
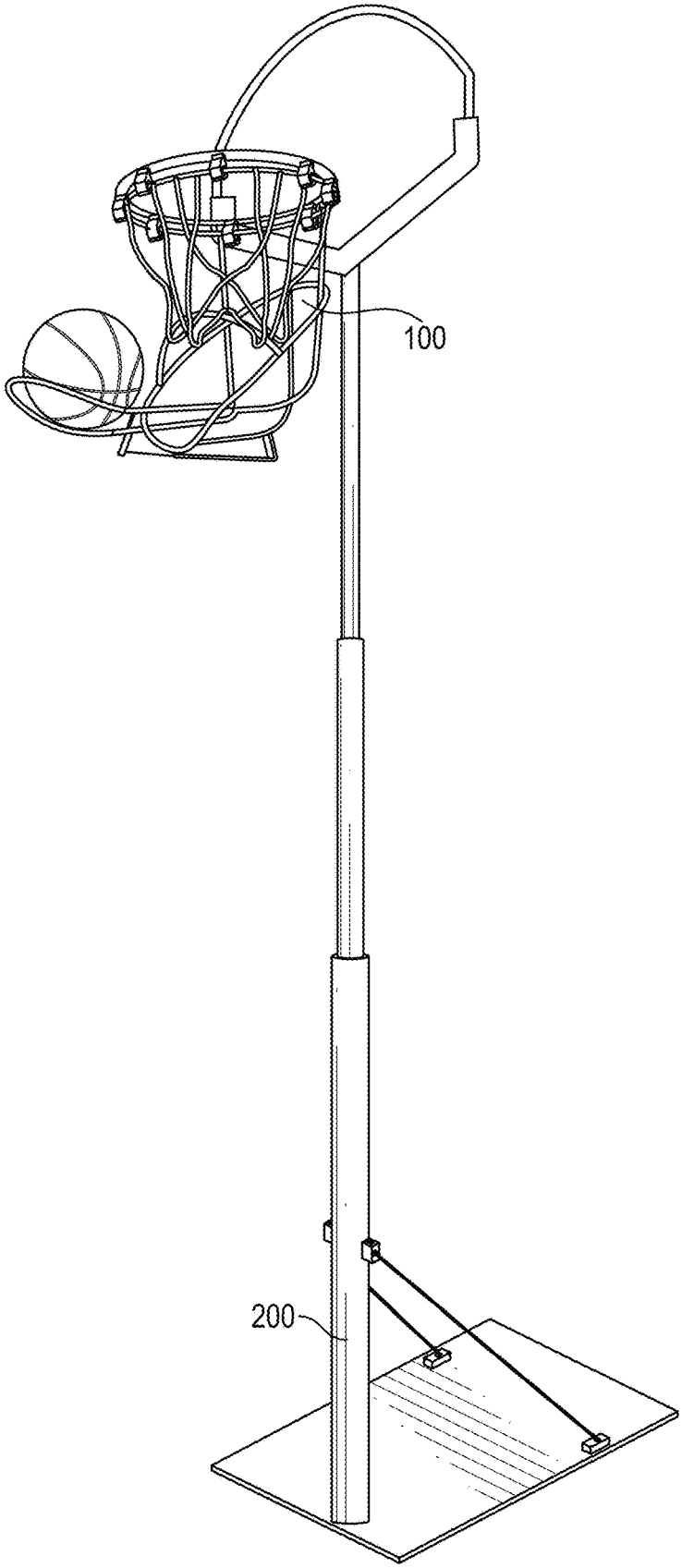
FIG. 5 illustrates a perspective view of a basketball rebounding apparatus coupled to a basketball hoop.

As shown in FIGS. 1-4, in one embodiment, a basketball rebounding apparatus 100 comprises a first frame 102 with a first arm 104A and a second arm 104B. The first frame 102 may be cylindrical so as to match the size and shape of a conventional basketball rim. The first frame 102 may rest upon an upper surface of a basketball rim, as shown in FIG. 5. In some embodiments, the first frame 102 may comprise various shapes, such as square-shaped or ovular at a size to receive a men's, women's, or youth basketball. The first frame 102 may comprise an aperture 106 that allows a basketball to pass therethrough. Further, the first frame 102 may vary in diameter, which could make the aperture 106 that leads to the basketball hoop smaller, for example, so as to help a user's shooting accuracy.

The first frame 102 may comprise a plurality of first fasteners 108 so as to allow the first frame 102 to couple to the basketball rim. The first fasteners 108 may be spaced apart an equal distance around the first frame 102 and descend below the first frame 102. In some embodiments, the first fasteners 108 may be positioned above the first frame 102. The first fasteners 108 may comprise a first finger 110A and a second finger 110B at a first end, with a channel 111 interposed between the first and second fingers 110A, 110B. The first and second fingers 110A, 110B may be manufactured from a rubber, plastic, or metal material that is pliable so as to grip the basketball rim. The first channel 111 on the first fasteners 108 is configured to receive the basketball rim. At a second end, the first fastener 108 may comprise a nut that couples to a bolt. While the first fastener 108 is shown as having a bolt and nut, it will be understood that the first fastener 108 may include a clip, a cotter pin, a safety pin, a clevis pin, or any other type of fastening mechanism. The bolt may be coupled to the first and second fingers 110A, 110B. For example, the bolt may be molded into material positioned between the first and second fingers 110A, 110B. It will be understood that the first fastener 108 may pass through the first frame 102 and be removably attachable thereto. When the first fasteners 108 are in position, the first frame 102 may be coupled to the basketball rim. It will be appreciated that while the first fastener 108 is shown as a clamp with a bolt, the first fastener 108 may, in some embodiments, be comprised of brackets, screws, or any other type of fastening mechanism.

The first and second arms 104A, 104B may couple to a bottom surface of the first frame 102 via, for example, welding, nuts and bolts, or any other type of coupling mechanism. In particular, a first end 112A and a second end 112B of the first and second arms 104A, 104B, respectively, may couple to the first frame 102. Further, a third end 114A and a fourth end 114B (opposite the first and second ends 112A, 112B) of the first and second arms 104A, 104B, respectively, may receive a second frame 116 that is hingedly coupled thereto with a second fastener 118 (e.g., screws, pins, bolts and nuts). In particular, the third and fourth ends 114A, 114B of the first and second arms 104A, 104B may comprise a first recessed portion 120A and a second recessed portion 120B, respectively (shown in FIG. 3). Due to the first and second recessed portions 120A, 120B, the third end 114A of the first arm 104A may also comprise a first finger 122A, and the fourth end 114B of the second arm 104B may comprise a second finger 122B. The second frame 116 may be u-shaped and comprise a third arm 124A and a fourth arm 124B. The third arm 124 of the second frame 116 may comprise a third recessed portion 126A and a third finger 128A. The fourth arm 124B of the second frame 116 may comprise a fourth recessed portion 126B and a fourth finger 128B. The first finger 122A may be positioned in the third recessed portion 126A and the third finger 128A may be positioned in the first recessed portion 120A. The second finger 122B may be positioned in the fourth recessed portion 126B and the fourth finger 128B may be positioned in the second recessed portion 120B. Accordingly, the second frame 116 may move from an upright position to a lowered position.

Further, the second frame 116 may be angled upward in relation to the third and fourth ends 114A, 114B of the first and second arms 104A, 104B. The second frame 116 may further comprise a support member 130 (FIG. 4) that may be coupled to a lower surface of the second frame 116, thereby adding additional support. The support member 130 may be perpendicular to the third and fourth arm 124A, 124B on the second frame 116. The support member 130 may include a first bracket 132 coupled thereto that has a first bracket aperture and a first bracket fastener. It will be appreciated that the second frame 116 can hold a basketball in place so that a user can pull it from the second frame 116. That is, after a user shoots the basketball and it goes in the basketball hoop, the basketball will pass through the basketball rebounding apparatus 100 until stopping on the second frame 116, where it will stay until removed by a user.

The basketball rebounding apparatus 100 further includes a cage 134 coupled thereto that retains a basketball 136 after a user shoots the ball into the basketball hoop. The cage 134 may comprise a first cage member 138, a second cage member 140, a third cage member 142, and a fourth cage member 144 (FIG. 1). The first cage member 138 may be coupled to a rear side of the first and second arms 104A, 104B in one or more locations. The first cage member 138 may comprise a first cage member end 146A and a second cage member end 146B. The second cage member 140 may be coupled to the first cage member 138 and extend over the first and second arms 104A, 104B so as to retain the basketball in the basketball rebounding apparatus 100 once it enters the basketball hoop. The third cage member 142 may be positioned under the first and second arms 104A, 104B and be coupled to the first and second arms 104A, 104B and/or the first cage member end 146A and the second cage member end 146B. The third cage member 142 may be positioned between the first and second arms 104A, 104B, perpendicular thereto, so as to add support and act as an additional guide as the basketball rolls to the second frame 116. The fourth cage member 144 may be positioned in between the first and second arms 104A, 104B and be parallel thereto. The fourth cage member 144 may couple to the first cage member 138 at one end and the third cage member 142 at an opposite end. The fourth cage member 144 may comprise a second bracket 148 that descends below the fourth cage member 144. The second bracket 148 may comprise a second bracket aperture 150 and a second bracket fastener 152.

In addition, a spring 154 (e.g., a pneumatic spring) may control the motion of the second frame 116. That is, when a user places a certain amount of pressure on the spring 154, the second support 116 may lower, thereby releasing a basketball to the user. The spring 154, for example, may be coupled to the fourth cage member 144 and the support member 130 via the first and second brackets 132, 148. While a pneumatic spring is shown, it will be appreciated that metal wire springs may be used or any other type of spring mechanism. In some embodiments, the spring 154 may comprise an adjustable tensioner, so as to increase or decrease tension, thereby making it easier to remove the basketball or harder. In other embodiments, the spring 154 may be removably attachable to the basketball rebounding apparatus 100, and the basketball rebounding apparatus 100 may utilize additional pneumatic springs that vary with regard to tension so that youth or adults may be able to remove the basketball from the second frame 116 by releasing the pneumatic spring 154.

As shown in FIG. 5, the basketball rebounding apparatus 100 may be coupled to a basketball hoop. It will be appreciated that once the basketball rebounding apparatus 100 is coupled to the rim of the basketball hoop, a user may shoot the basketball through the basketball hoop so as to position the basketball on the second frame 116. At that point, a user may jump up and pull the basketball down, thereby activating the spring 154 to release the basketball. After the basketball is removed, the second frame 116 via the spring 154 may reset to a resting position, ready to receive another basketball.

Figure 6:
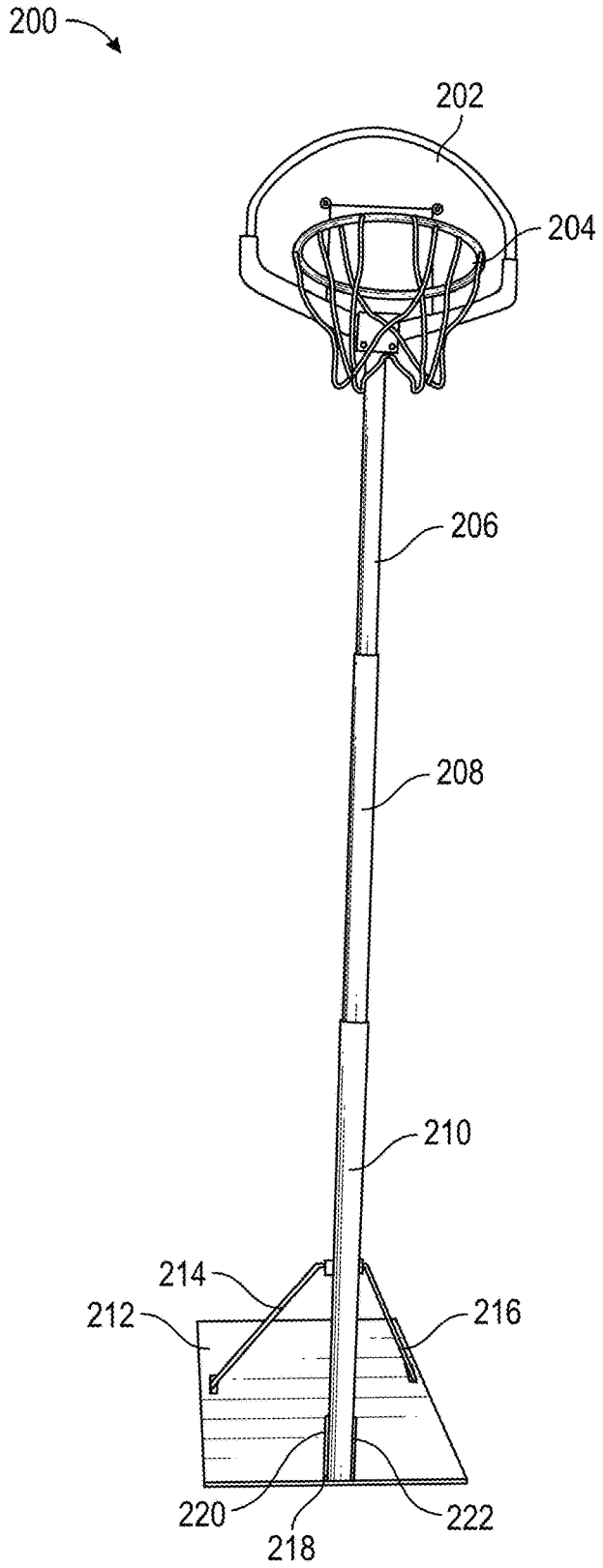
FIG. 6 illustrates a front perspective view of an adjustable basketball hoop.
Figure 7:
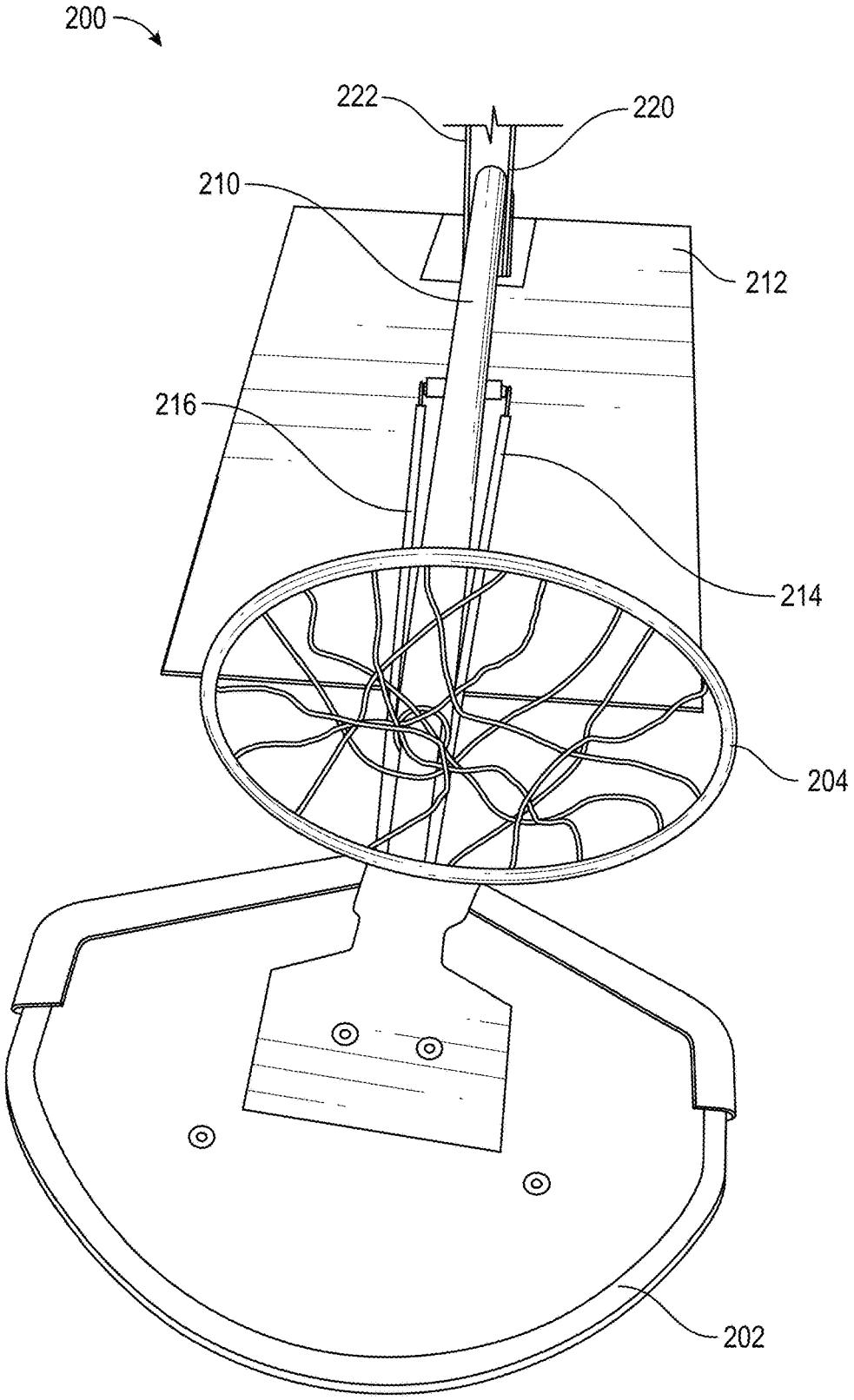
FIG. 7 illustrates a top perspective view of an adjustable basketball hoop.

In one embodiment, as illustrated in FIGS. 6-7, an adjustable basketball hoop 200 comprises a back panel 202 (i.e., backboard), a rim 204, a first shaft 206 positionable into a second larger shaft 208 and the first and second shafts 206, 208 positionable into a third shaft 210 that is larger than both the first and second shafts 206, 208. With the shafts 206, 208, 210 positionable one inside the other, the adjustable basketball hoop 200 can be raised or lowered to numerous heights. The adjustable basketball hoop 200 further comprises a base 212 with a first support arm 214 and a second support arm 216 both hingedly coupled to the third shaft 210. In addition, the third shaft 210 is coupled to the base 212 via a bracket 218 comprising a first sidewall 220 and a second sidewall 222. It will be appreciated that the third shaft 210 may be hingedly coupled to the bracket 218 so that the third shaft 210 may fold and contact the base 212. Once against the base 212, the adjustable basketball hoop 200 may be easily transported. In some embodiments, the adjustable basketball hoop 200 may be used in tandem with the basketball rebounding apparatus 100 to increase basketball skills.

As shown in FIGS. 8-13, in one embodiment, a basketball rebounding apparatus 300 comprises a first frame 302 removably attachable to a first arm 304A and a second arm 304B. The first frame 302 may be cylindrical and rest upon an upper surface of a basketball rim. In some embodiments, the first frame 302 may comprise various shapes, such as square-shaped or ovular at a size to receive a men's, women's, or youth basketball. The first frame 302 may comprise an aperture 306 that allows a basketball to pass therethrough. Further, the first frame 302 may vary in diameter, which could make the aperture 306 that leads to the basketball hoop smaller, for example, so as to help a user's shooting accuracy.

Figure 8:
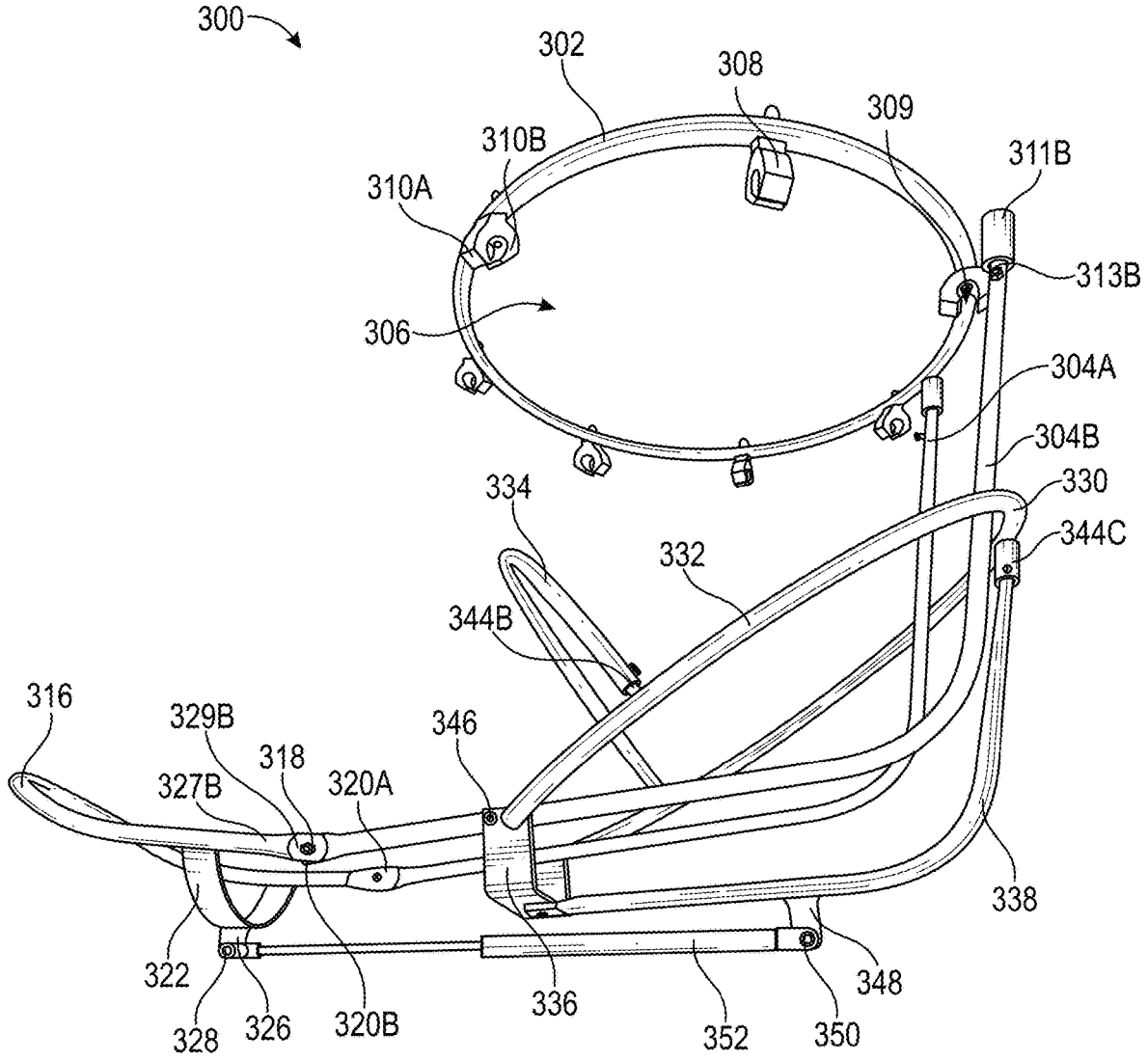
FIG. 8 illustrates a right, side perspective view of a basketball rebounding apparatus.
Figure 9:
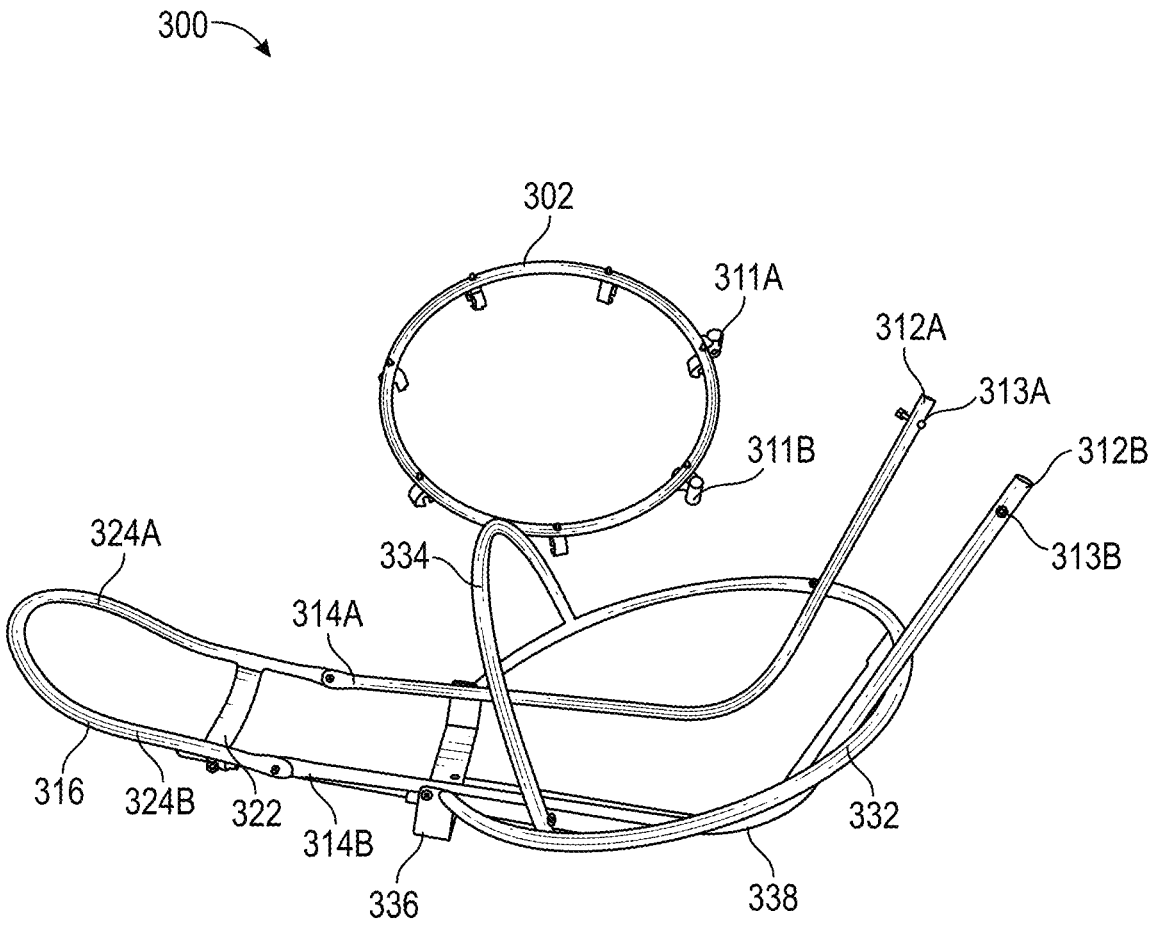
FIG. 9 illustrates a right, side perspective view of a basketball rebounding apparatus with a first frame removed.
Figure 10:
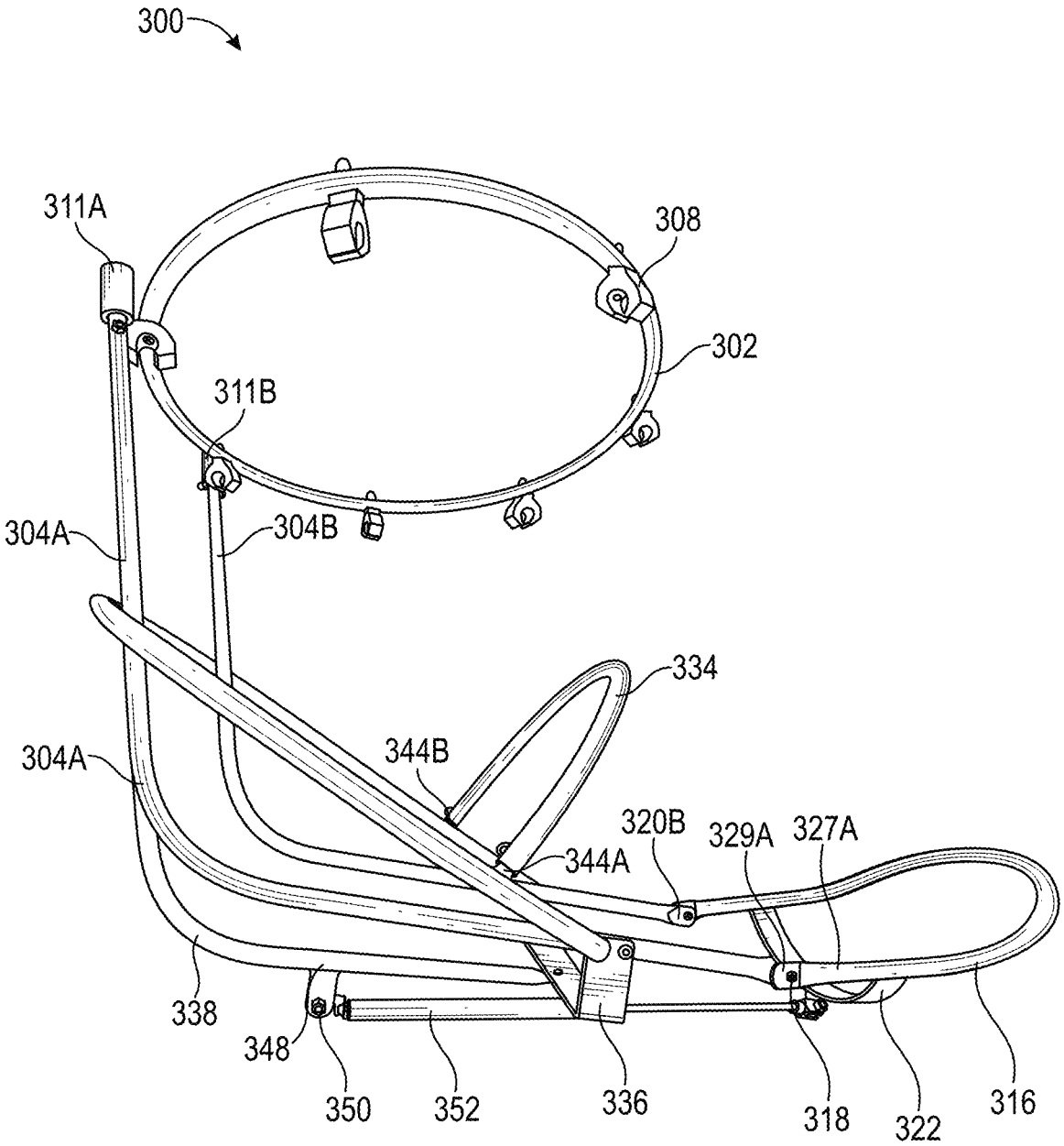
FIG. 10 illustrates a left, side perspective view of a basketball rebounding apparatus.

Referring to FIGS. 8-10, the first frame 302 may comprise a plurality of first fasteners 308 so as to allow the first frame 302 to couple to the basketball rim. The first fasteners 308 may comprise a first finger 310A and a second finger 310B at a first end, with a channel 309 interposed between the first and second fingers 310A, 310B. At a second end, the first fastener 308 may comprise a nut that couples to a bolt. The bolt may be coupled to the first and second fingers 310A, 310B. It will be understood that the first fastener 308 may pass through the first frame 302 and be removably attachable thereto. When the first fasteners 308 are in position, the first frame 302 may be coupled to the basketball rim. It will be appreciated that while the first fastener 308 is shown as a clamp with a bolt, the first fastener 308 may, in some embodiments, be comprised of brackets, screws, or any other type of fastening mechanism. Furthermore, the first frame 302 may comprise a first receiving member 311A (e.g., a tube) that interacts with a first receiving fastener 313A and a second receiving member 311B (e.g., a tube) that interacts with a second receiving fastener 313B. The first and second receiving members 311A, 311B may be configured to receive the first and second arms 304A, 304B and be removably attachable. The first and second receiving members 311A, 311B may be generally cylinder-shaped so that the first and second arms 304A, 304B may be inserted therein, meaning the first and second receiving members 311A, 311B are larger in diameter than the first and second arms 304A, 304B. In some embodiments, the first and second receiving members 311A, 311B are smaller in diameter than the first and second arms 304A, 304B so that the first and second receiving members 311A, 311B may be positioned in the first and second arms 304A, 304B. The first and second receiving fasteners 313A, 313B are shown as nuts and bolts; however, other fasteners may be utilized, such as cotter pins or lynch pins.

The first and second arms 304A, 304B may couple to a bottom surface of the first frame 302 as discussed above or via welding, or any other type of coupling mechanism. In particular, a first end 312A, 312B of the first and second arms 304A, 304B may couple to the first frame 302. Further, a second end 314A, 314B of the first and second arms 304A, 304B may receive a second frame 316 that is hingedly coupled thereto with a second fastener 318 (e.g., screws, pins, bolts and nuts). In particular, the second end 314A, 314B of the first and second arms 304A, 304B may comprise a first flattened end 320A and a second flattened end 320B both with apertures therethrough.

Further, the second frame 316 may be angled upward in relation to the second ends 314A, 314B of the first and second arms 304A, 304B. The second frame 316 may further comprise a support member 322 that may be coupled to a lower surface of the second frame 316, thereby adding additional support and providing a resting location for a basketball. The support member 322 may be perpendicular to a third arm 324A and a fourth arm 324B of the second frame 316. The support member 322 may include a first bracket 326 coupled thereto that has a first bracket aperture and a first bracket fastener 328. The second frame 316 may comprise a third end 327A and a fourth end 327B on the third arm 324A and the fourth arm 324B, respectively. The third end 327A may comprise a third flattened end 329A and the fourth end 327B may comprise a fourth flattened end 329B. The first flattened end 320A may contact and be hingedly coupled to the third flattened end 329A via the second fastener 318. The second flattened end 320B may contact and be hingedly coupled to the fourth flattened end 329B via the second fastener. It will be appreciated that the second frame 316 can hold a basketball in place so that a user can pull it from the second frame 316. That is, after a user shoots the basketball and it goes in the basketball hoop, the basketball will pass until stopping on the second frame 316 and support member 322, where it will stay until removed by a user.

Figure 11:
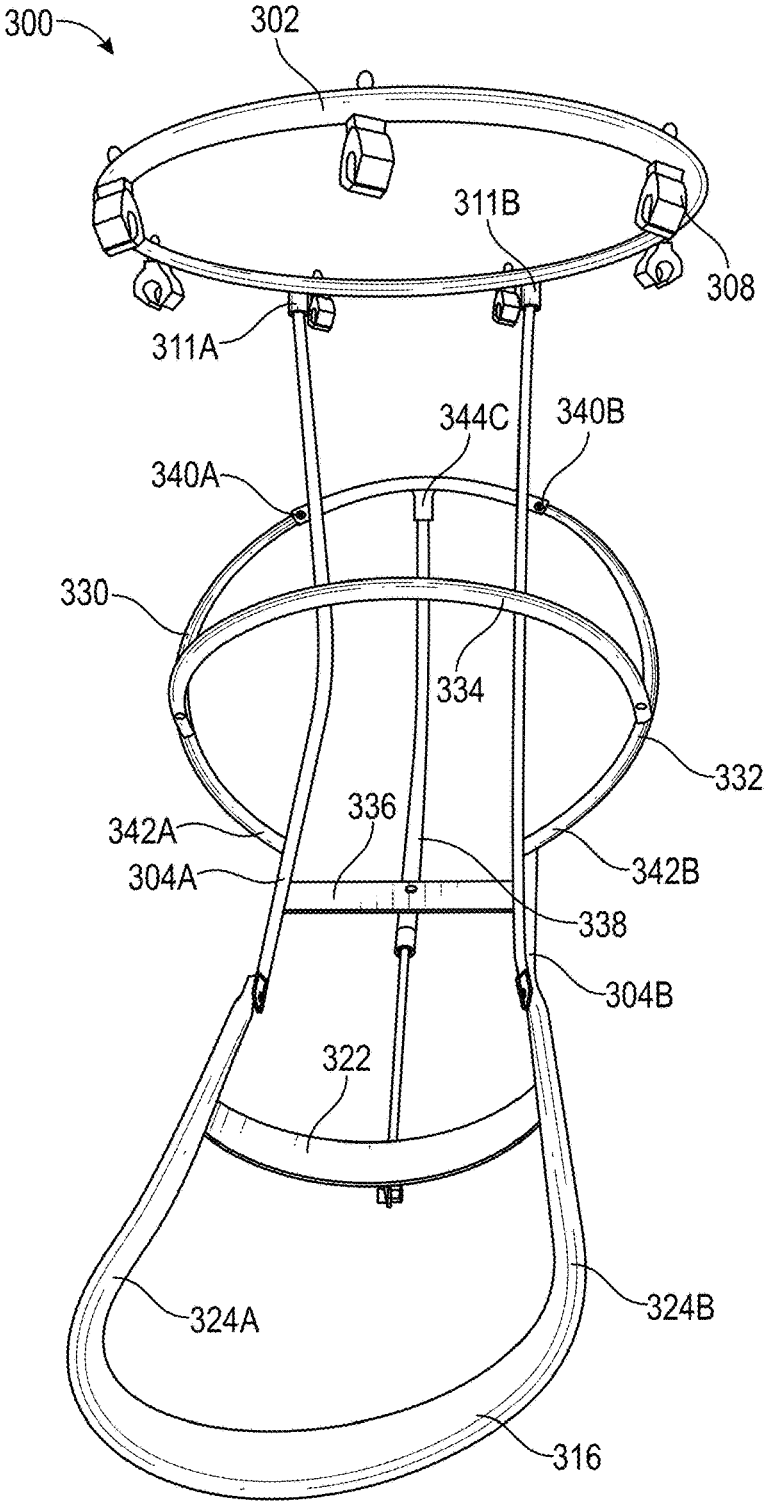
FIG. 11 illustrates a front perspective view of a basketball rebounding apparatus.
Figure 12:
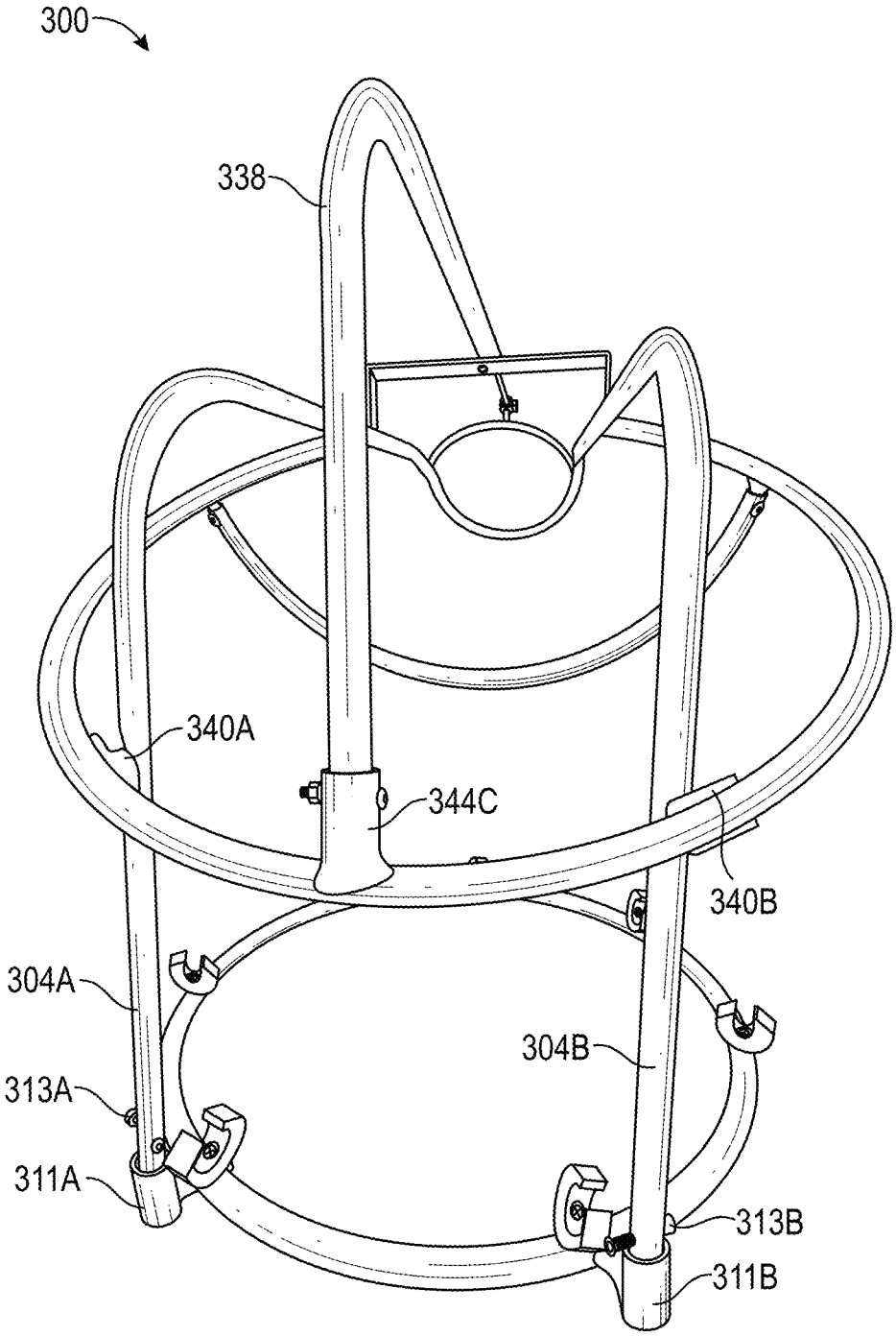
FIG. 12 illustrates a rear perspective view of a basketball rebounding apparatus.
Figure 13:
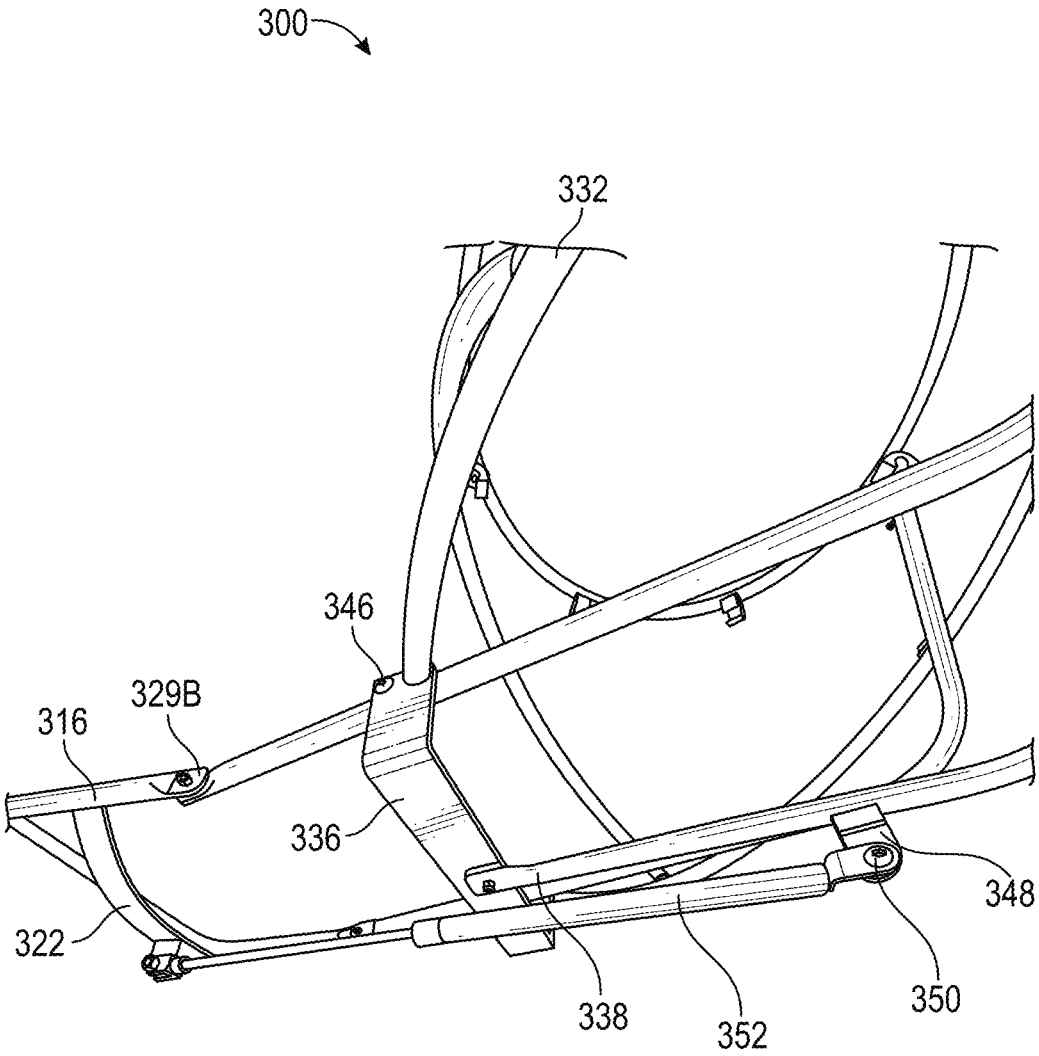
FIG. 13 illustrates a bottom perspective view of a basketball rebounding apparatus.
Figure 14:
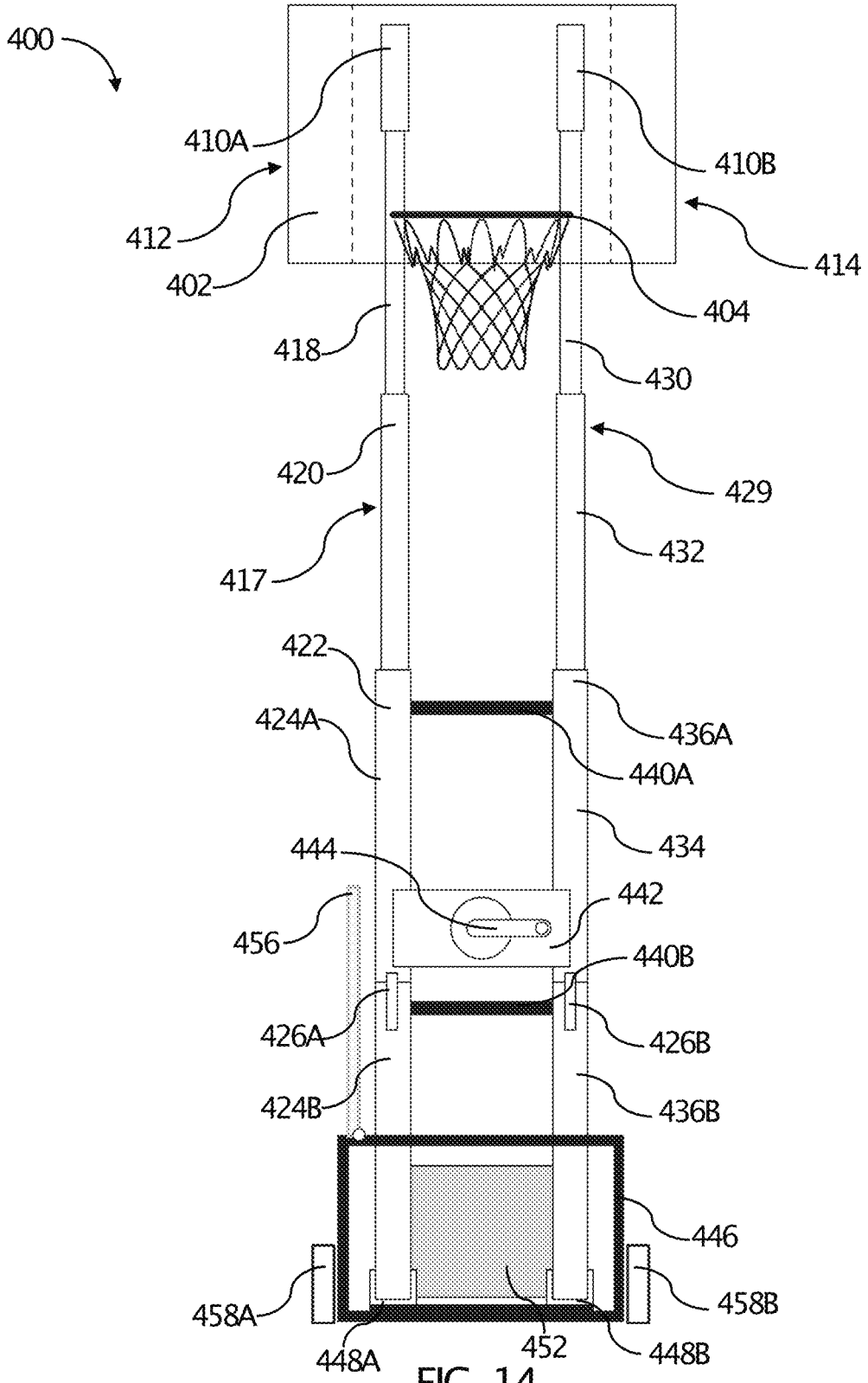
FIG. 14 illustrates a front elevation view of an adjustable basketball hoop of a basketball rebounding system.
Figure 15:
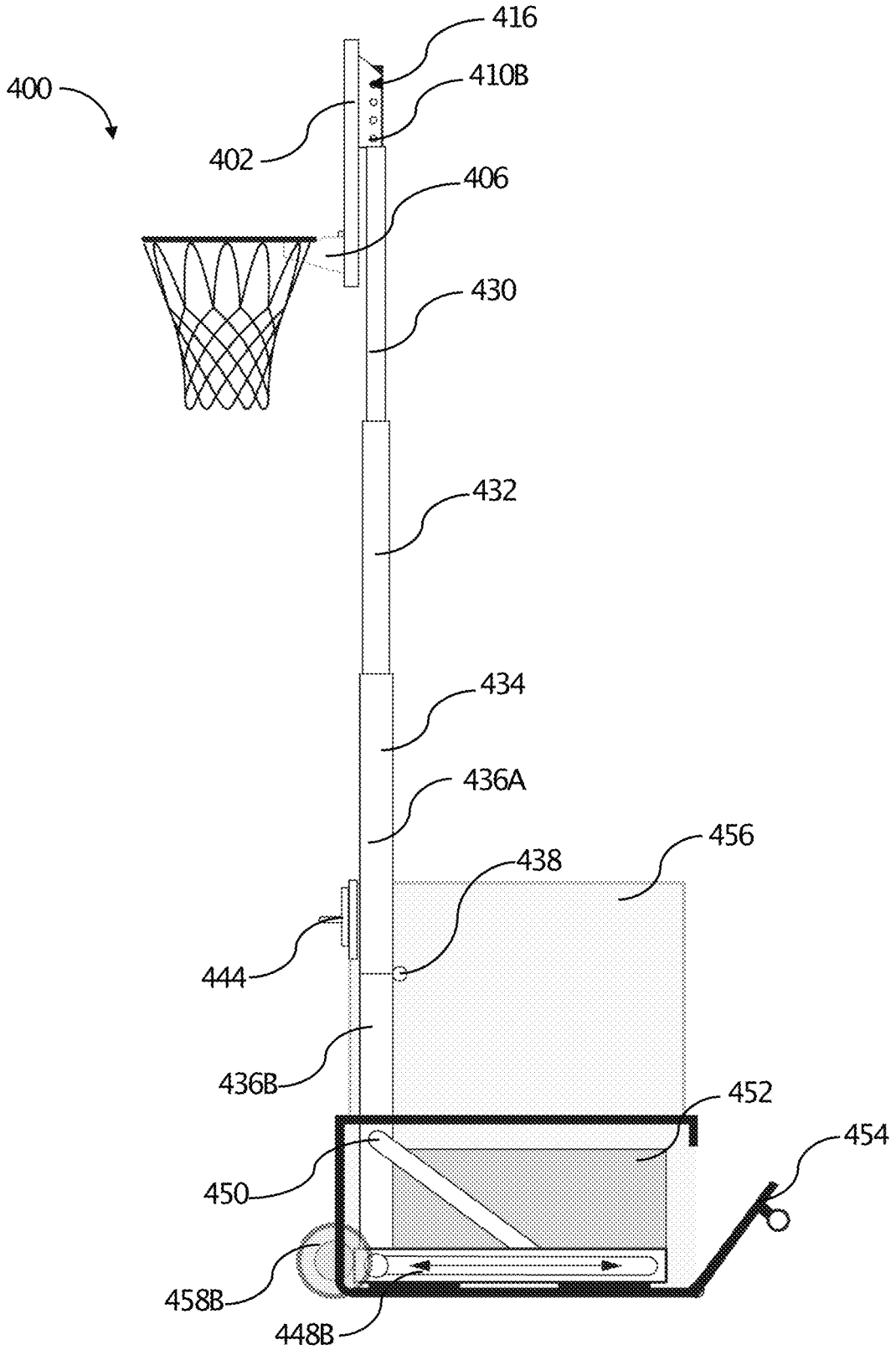
FIG. 15 illustrates a side elevation view of an adjustable basketball hoop of a basketball rebounding system.
Figure 16:
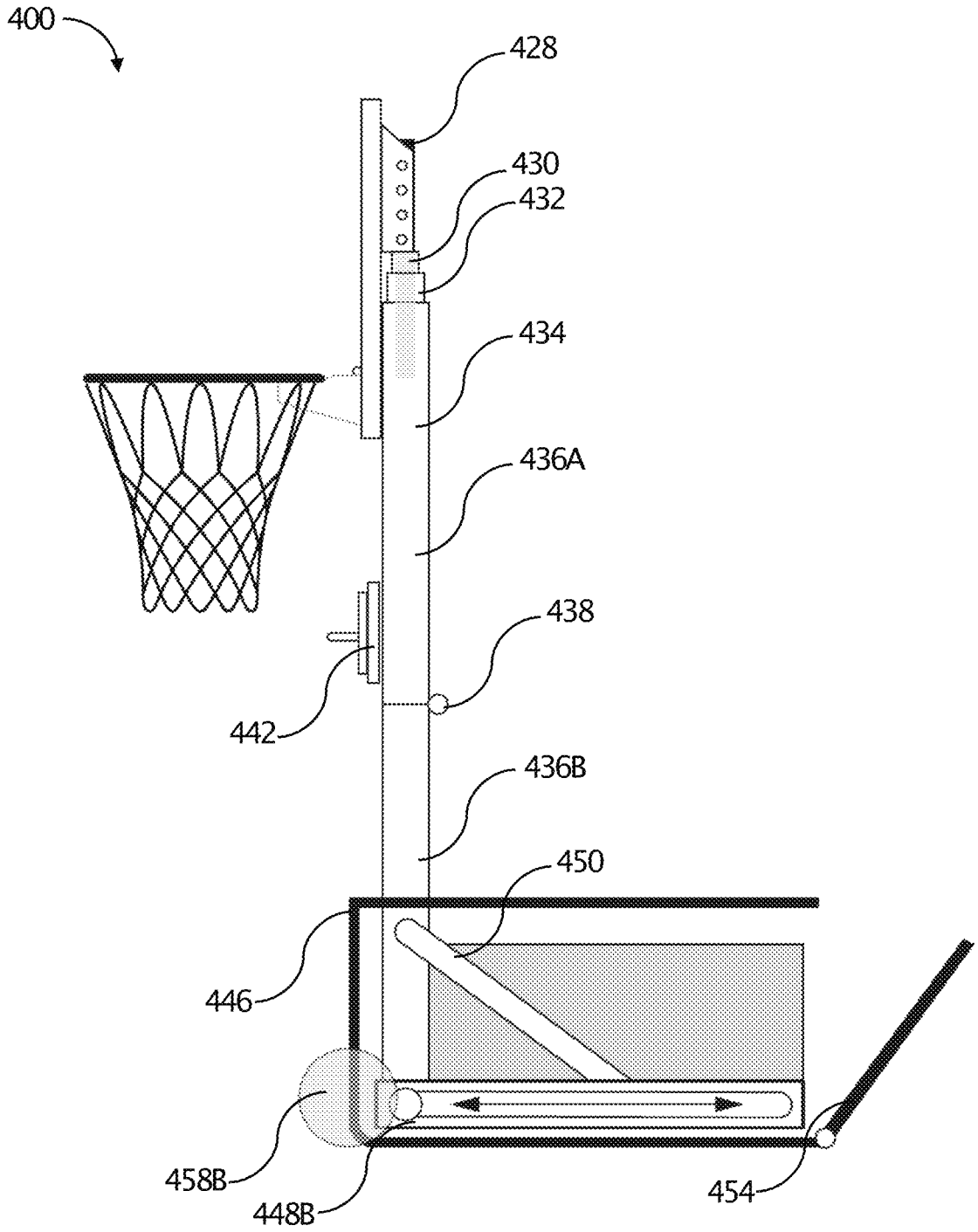
FIG. 16 illustrates a side elevation view of an adjustable basketball hoop of a basketball rebounding system.
Figure 17:
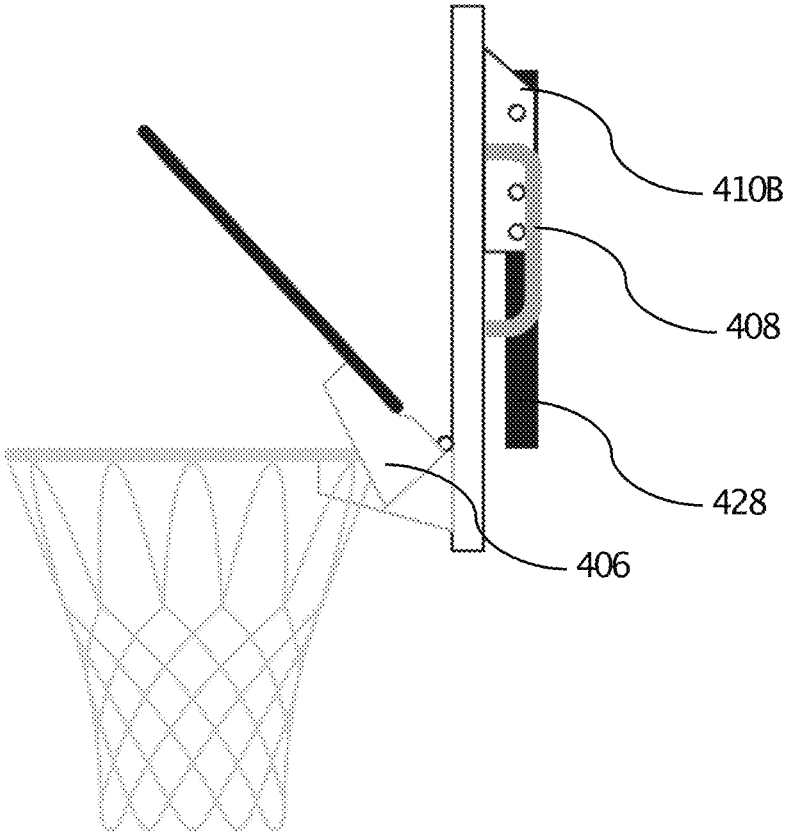
FIG. 17 illustrates a side elevation view of an adjustable basketball hoop of a basketball rebounding system.
Figure 18:
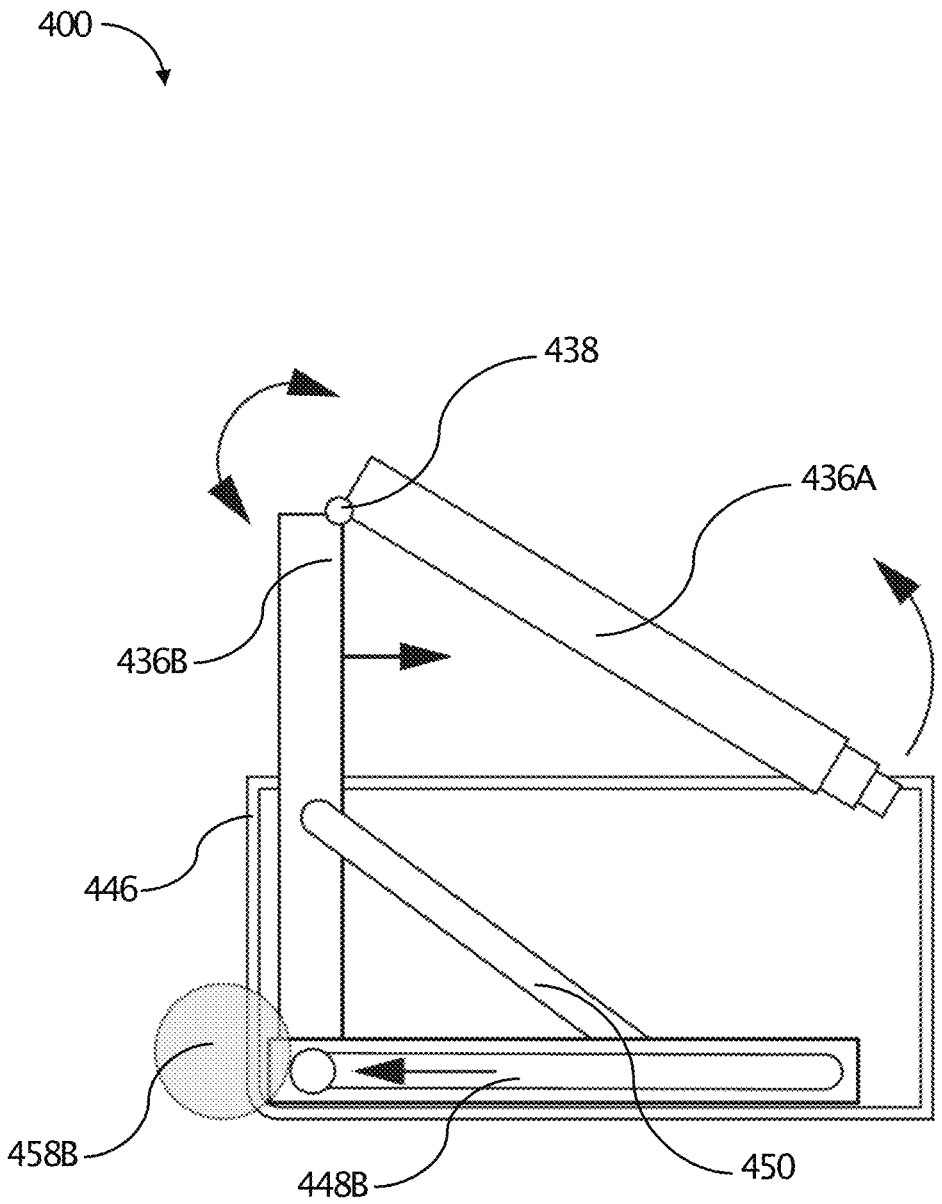
FIG. 18 illustrates a side elevation view of an adjustable basketball hoop of a basketball rebounding system.
Figure 19:
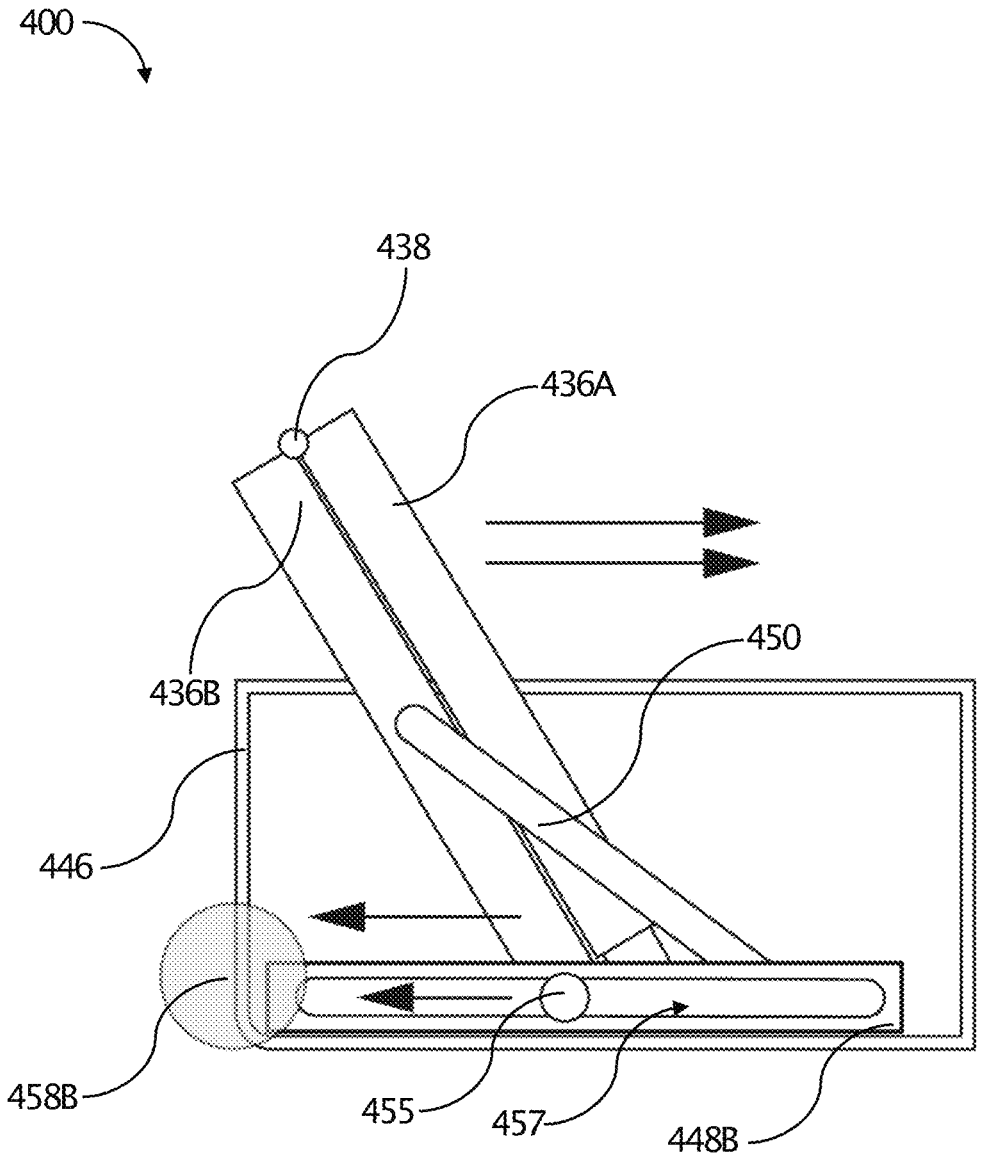
FIG. 19 illustrates a side elevation view of an adjustable basketball hoop of a basketball rebounding system.
Figure 20:
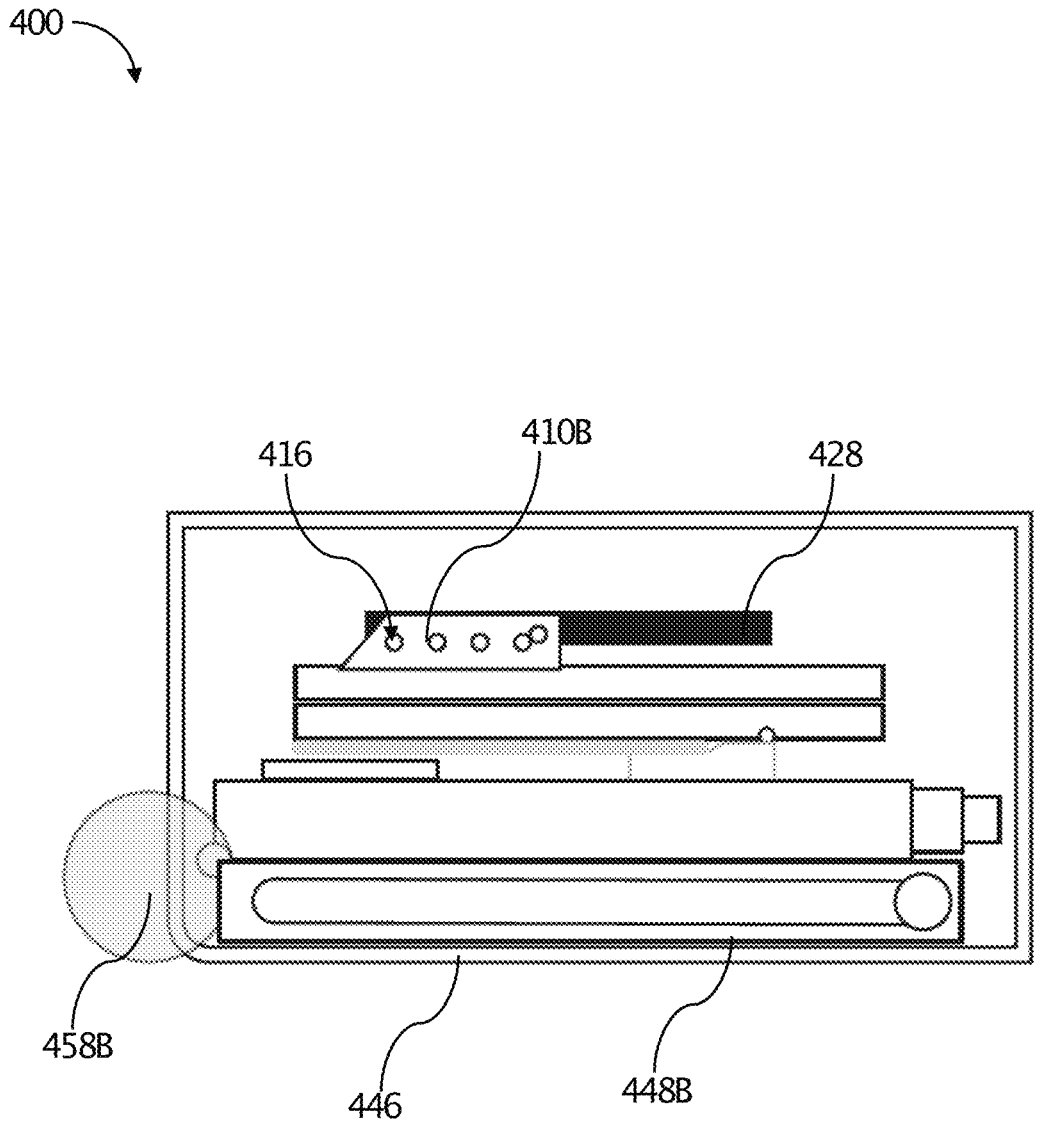
FIG. 20 illustrates a side elevation view of an adjustable basketball hoop of a basketball rebounding system.

Referring to FIGS. 11-13, the basketball rebounding apparatus 300 further includes a cage 330 coupled thereto that retains a basketball after a user shoots the ball into the basketball hoop. That is, as the basketball enters the first frame 302 and rolls down the first and second arms 304A, 304B, the cage 330 keeps the ball in the apparatus 300. The cage 330 may comprise a first cage member 332, a second cage member 334, a third cage member 336, and a fourth cage member 338.

The first cage member 332 may be coupled to a rear side of the first and second arms 304A, 304B in at least two locations. More particularly, the first cage member 332 may couple to the first and second arms 304A, 304B via a first, curved coupler 340A on the first arm 304A and a second, curved coupler 340B on the second arm 304B. The first and second curved couplers 340A, 340B may comprise bolts, lynch pins, etc. The first and second curved couplers 340A, 340B may be configured in size and shape to mate with the first cage member 332. That is, both the first and second curved couplers 340A, 340B may comprise a first and a second concave portion, respectively, that are each configured to receive the first cage member 332. The first cage member 332 may comprise a first cage member end 342A and a second cage member end 342B.

The second cage member 334 may be coupled to the first cage member 332 so as to retain the basketball in the basketball rebounding apparatus 300 once it enters the basketball hoop. The second cage member 334 may be removably attachable to the first cage member 332 via bolts and nuts, lynch pins, etc. through one or more second cage apertures. To be coupled to the first cage member 332, the second cage member 334 may be placed on a first protrusion 344A and a second protrusion 344B both of which may be extending upward from the first cage member end 342A and the second cage member end 342B, respectively. The first protrusion 344A (FIG. 10) may comprise a first protrusion aperture and the second protrusion 344B (FIG. 8) may comprise a second protrusion aperture. Both the first protrusion aperture and the second protrusion aperture may align with the second cage apertures so as to receive the fastening mechanism, such as bolts or lynch pins. The first cage member 332 may include a third protrusion 344C extending downward. The third protrusion 344C may comprise third protrusion apertures to receive a fastener similar to those mentioned above, such as a bolt and nut or lynch pin. The third protrusion 344C may be configured to receive an end of the fourth cage member 338 therein so as to be removably attachable thereto.

The third cage member 336 may be positioned under the first and second arms 304A, 304B and be coupled to the first cage member end 342A, the second cage member end 342B, and the first and second arms 304A, 304B (shown in FIG. 13). As an example, the first and second cage member ends 342A, 342B may be welded, or secured through other fastening mechanisms, to outer sides of the third cage member 336, and the third cage member 336 may be coupled to the first and second arms 304A, 304B via bolts 346 or any other means of securement. The third cage member 336 may be positioned between the first and second arms 304A, 304B, being perpendicular thereto, so as to add support and act as an additional guide as the basketball rolls to the second frame 316.

The fourth cage member 338 may be positioned in between the first and second arms 304A, 304B and be parallel thereto. The fourth cage member 338 may couple and be removably attachable to the first cage member 332 at one end and the third cage member 336 at an opposite end. The fourth cage member 338 may comprise a flattened end that contacts the bottom surface of the third cage member 336 so as to be secured. The fourth cage member 338 may comprise a second bracket 348 that descends below the fourth cage member 338. The second bracket 348 may comprise a second bracket aperture and a second bracket fastener 350.

In addition, a spring 352 (e.g., a pneumatic spring) may control the motion of the second frame 316. That is, when a user places a certain amount of pressure on the spring 352, the second support 316 may lower, thereby releasing a basketball to the user. The spring 352 may be coupled to the fourth cage member 338 and the support member 322 via the first and second brackets 326, 348. While a pneumatic spring is shown, it will be appreciated that metal wire springs may be used or any other type of spring mechanism. In some embodiments, the spring 352 may comprise an adjustable tensioner, so as to increase or decrease tension, thereby making it easier to remove the basketball or harder. In other embodiments, the spring 352 may be removably attachable to the basketball rebounding apparatus 300, and the apparatus 300 may utilize additional pneumatic springs that vary with regard to tension so that youth or adults may be able to remove the basketball from the second frame by releasing the pneumatic spring 352.

The basketball rebounding apparatus 300 may be coupled to a basketball hoop. It will be appreciated that once the basketball rebounding apparatus 300 is coupled to the rim of the basketball hoop, a user may shoot the basketball through the basketball hoop so as to position the basketball on the second frame 316, the second frame 316 being in a first, resting position. At that point, a user may jump up and pull the basketball down, thereby activating the spring 352 to release the basketball, moving the second frame 316 to a second, release position. After the basketball is removed, the second frame 316 via the spring 352 may automatically reset to the first position, ready to receive another basketball.

A basketball rebounding system may include the adjustable rebounding apparatus 100 and an adjustable basketball hoop 400. In one embodiment, as illustrated in FIGS. 14-20, the adjustable basketball hoop 400 may comprise a back panel 402 (i.e., backboard) and a rim 404. The rim 404 may be coupled to the back panel 402 via a rim bracket 406 that is hingedly coupled to the back panel 402. Accordingly, the rim 404 may pivot towards and against the back panel 402 for storage. The back panel 402 may comprise a first panel handle (Not shown, similar to a second panel handle described hereinafter) and a second panel handle 408 (FIG. 17), both of which may assist a user in the setting up and taking down of the adjustable basketball hoop 400. The back panel 402 may comprise, on a rear side, a first bracket 410A on a first side 412 and a second bracket 410B on a second side 414. The first bracket 410A may include a plurality of first apertures (Not shown) that assist in adjustment, and the second bracket 410B may include a plurality of second apertures 416 that assist in adjustment. The first bracket 410A may receive a first rod (Not shown) via bolts and nuts, screws, latches, clamps, etc. The first rod may fasten to and extend into a first leg 417. In particular, the first rod may fasten to and extend at least into a first shaft 418, which the first shaft 418 is positionable into a second, larger shaft 420 and the first and second shafts 418, 420 positionable into a third shaft 422 that is larger in diameter than both the first and second shafts 418, 420, meaning the first, second, and third shafts 418, 420, 422 are telescopic. The third shaft 422 may comprise a first section 424A coupleable to a second section 424B via a first fastener 426A and a first hinge (Not shown, similar to a second hinge described below). The second bracket 410B may receive a second leg second rod 428 via bolts and nuts, screws, latches, clamps, etc. The second rod 428 may fasten to and extend into a second leg 429. In particular, the second rod 428 may fasten to and extend at least into a fourth shaft 430, which the fourth shaft 430 is positionable into a fifth, larger shaft 432 and the fourth and fifth shafts 430, 432 may be positionable into a sixth shaft 434 that is larger in diameter than both the fourth and fifth shafts 430, 432, meaning the fourth, fifth, and sixth shafts 430, 432, 434 are telescopic. The sixth shaft 434 may comprise a third section 436A coupleable to a fourth section 436B via a second fastener 426B and a second hinge 438. Interposed between the first and third sections 424A, 436A may be a first handle 440A, and interposed between the second and fourth sections 424B, 436B may be a second handle 440B, both of which may assist a user in configuring the adjustable basketball hoop 400, meaning lifting the various sections 424A, 424B, 436A, 436B and shafts 418, 420, 422, 430, 432, 434 into place.

Further, a crank panel 442 comprising a crank actuator 444 may be coupled to the first section 424A of the third shaft 422 and the third section 436A of the sixth shaft 434. The crank actuator 444 may raise and lower the first, second, fourth, and fifth shafts 418, 420, 430, 432, thereby increasing or decreasing the height of the back panel 402 and the rim 404. Once a user reaches a desired height for the back panel 402 and the rim 404, the user may secure the crank actuator 448 so as to lock the back panel 402 and the rim 404 into the desired height. Other mechanisms may be used whether motorized or non-motorized to raise or lower the rim 404 and back panel 402.

Both the third shaft 422 and the sixth shaft 434 may extend into a housing 446 and couple to bases 448A, 448B that may be removably attachable to a bottom of the housing 446. The bases 448A, 448B may have a first support member (Not shown, similar to a second support member described hereinafter) that extends to the third shaft 422 and a second support member 450 that extends to the sixth shaft 434, respectively. The housing 446 may receive a weighted insert 452 (e.g., a sand insert) between the first support member and the second support member 450. It will be appreciated that the weighted insert 452 maintains the housing 446 and the adjustable basketball hoop 400 in a stationary location. Further, it will be appreciated that the weighted insert 452 may be easily removed so that the adjustable basketball hoop 400 may be folded and secured in the housing 446. The housing 446 may comprise a rear door 454, where a user may insert or remove the weighted insert 452. The housing 446 may also include a lid 456 that may be secured when the adjustable basketball hoop 400 is placed therein. The lid 456 may be hingedly coupled to the housing 446, or may, in some embodiments, rest on top thereof, be secured via latches, or couple via any other known mechanism in the art.

To fold the adjustable basketball hoop 400, a user may crank down the shafts 418, 420, 430, 432, by using the crank actuator 444, or pull them down. The user then may fold the rim 404 against the back panel 402. In some embodiments, the back panel 402 may be removed. The first section 424A and the third section 440A may fold with the aid of the first and second hinges 442 and slide into the housing 446 via a sliding actuator 455, which allows the third and sixth shafts 418, 434 to slide rearward in first and second tracks 457 in the bases 448A, 448B. The back panel 402 with the folded rim 402 may be removed and placed on top of the shafts 418, 420, 422, 430, 432, 434. The user may then secure the lid 456. If the adjustable basketball hoop 400 needs to be transported, the user may lift the housing 446 and roll it with one or more wheels 458A, 458B.

In one embodiment, as illustrated in FIGS. 21-26, a basketball apparatus 500 comprises a first leg 502, a second leg 504, and a panel 506 interposed between the first leg 502 and the second leg 504. The first leg 502 may be telescoping and comprise a first shaft 508 that is positionable into a second, larger shaft 510 and the first and second shafts 508, 510 may be positionable into a third shaft 512 that is larger in diameter than both the first and second shafts 508, 510. The first shaft 508 may be coupled to a base plate 513 that contacts the ground and adds stability to the basketball apparatus 500. The third shaft 512 may receive a first bracket 514 on an end opposite insertion of the second shaft 510 into the third shaft 512. The first bracket 514 may include a first rear plate (Not shown), a first front plate 516 shorter than the first rear plate, and a first channel (Not shown) interacting with a first bottom plate (Not shown) interposed between the first rear plate and the first front plate 516. The first bracket 514, in some embodiments, may have first rear plate and a first front plate 516 that are the same height. The first bracket 514 may include a first base 518 that is placed around the third shaft 512 and secured thereon. In some embodiments, the first base 518 may be configured to be positioned in the third shaft and secured therein. The first bracket 514 may be configured to receive a bottom of a basketball hoop backboard 520. The first bracket 514 may be coated in rubber, or any other material that prevents slippage and damage to the basketball hoop backboard 520.

The second leg 504 may be telescoping and comprise a fourth shaft 520 that is positionable into a fifth, larger shaft 522 and the fourth and fifth shafts 520, 522 may be positionable into a sixth shaft 524 that is larger in diameter than both the fourth and fifth shafts 520, 522. The fourth shaft 520 may be coupled to the base plate 513. The sixth shaft 524 may receive a second bracket 526 on an end opposite insertion of the fifth shaft 522 into the sixth shaft 524. The second bracket 526 may include a second rear plate 528, a second front plate 530 shorter than the second rear plate 528, and a second channel 532 interacting with a second bottom plate 534 interposed between the second rear plate 528 and the second front plate 530. The second bracket 526, in some embodiments, may have a second rear plate and a second front plate that are the same height. The second bracket 526 may include a second base 536 that is placed around the sixth shaft 524 and secured thereon. In some embodiments, the second base 536 may be configured to be positioned in the sixth shaft 524 and secured therein. The second bracket 526 may be configured to receive the bottom of a basketball hoop backboard 520. The second bracket 526 may be coated in rubber, or any other material that prevents slippage and damage to the basketball hoop backboard 520.

The first bracket 514 may be positioned on one side of the backboard 520 while the second bracket 526 may be positioned on an opposite side of the backboard 520 as the first bracket 514, meaning the first and second brackets 514, 526 may be spaced apart the width of the panel 506. As the first and second legs 502, 504 are extended the first and second brackets 514, 526 mate with or contact a lower surface of the backboard 520 while the base plate 513 contact the ground, securing the basketball apparatus 500.

The panel 506 may be generally square-shaped. The panel 506 may comprise a first track 538A and a second track 538B running parallel to each other and the third and sixth shafts 512, 524. The first and second tracks 538A, 538B may extend from an upper portion of the panel 506 to a lower portion of the panel 506. A primary basketball rim 540 may be coupled to an upper portion of the panel 506 via a rim bracket 542. A net of basketball hoop rim 544 may be placed in the primary rim 540 when the basketball apparatus 500 is in an extended position. The rim bracket 542 may couple to the panel 506, or in some embodiments, to the first and second tracks 538A, 538B. The rim bracket 542 may be moveable up and down or stationary. The primary rim 540 may receive a collapsible tube 546, such as a spring coil cloth/mesh tube, or any other type of collapsible tunnel/tube. The collapsible tube 546 may descend below the primary rim 540 and couple to a secondary basketball rim 548, thereby allowing basketballs going through the net to travel through the primary rim 540, through the collapsible tube 546, and through the secondary rim 548. The secondary basketball rim 548 may include a track bracket 550, which may include a first member 552 on a first side of the track bracket 550 and a second member 554 on a second side of the track bracket 550. The first and second members 552, 554 may couple to and interact with the first and second tracks 538A, 538B, respectively. Accordingly, the second rim 548 may move up and down based on a height desired by a user.

Figure 21:
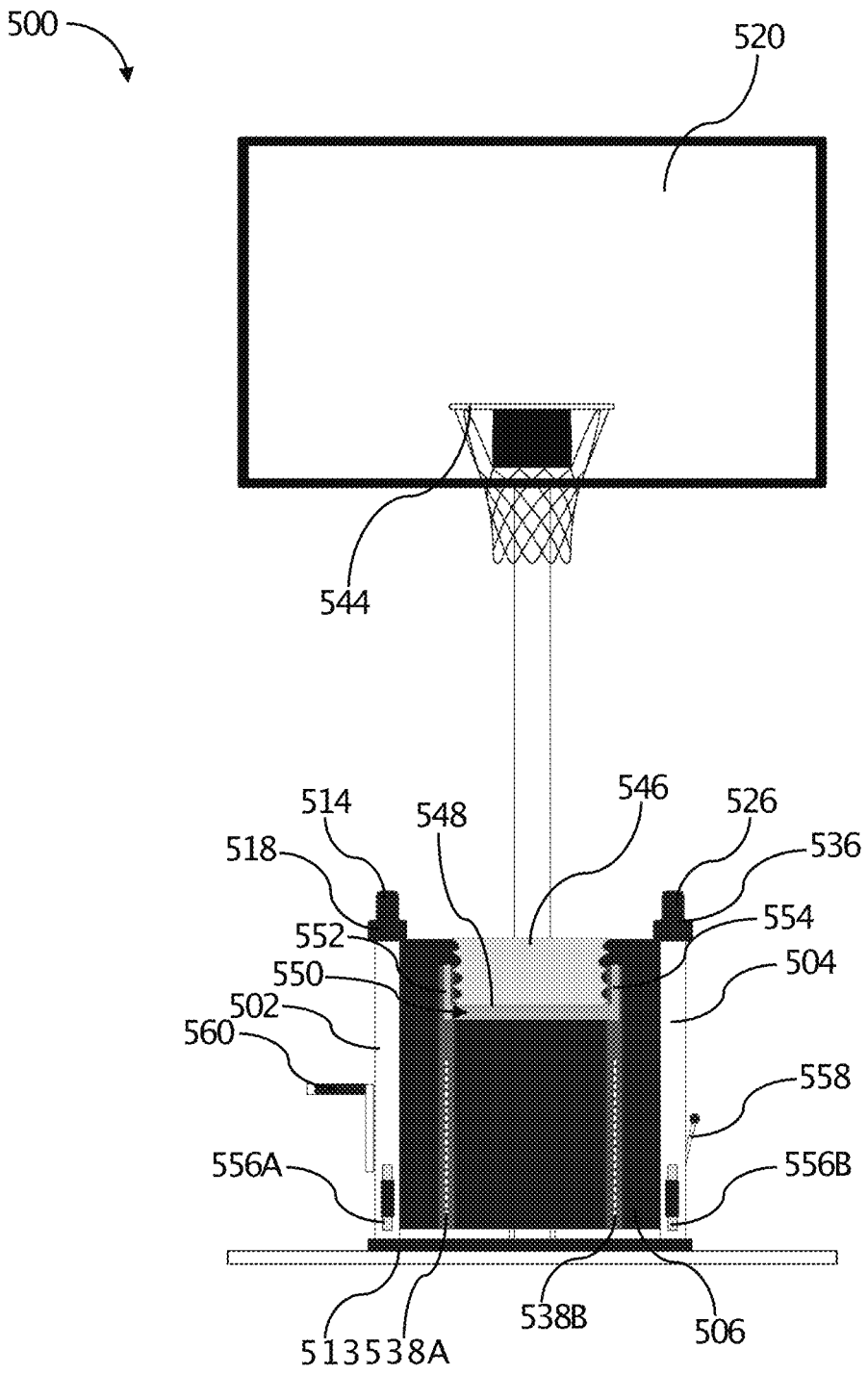
FIG. 21 illustrates a front elevation view of a basketball hoop apparatus.
Figure 22:
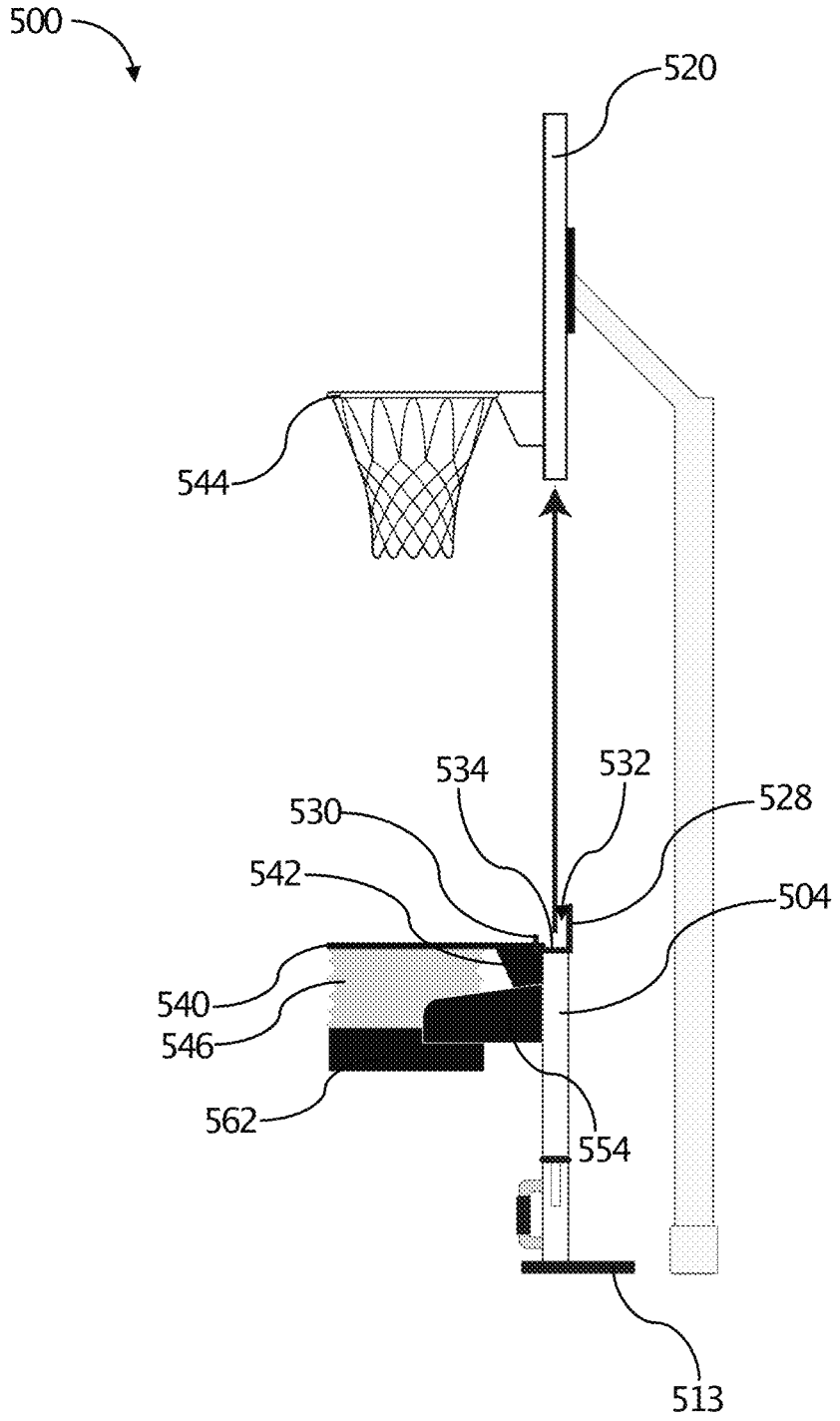
FIG. 22 illustrates a side elevation view of a basketball hoop apparatus.
Figure 23:
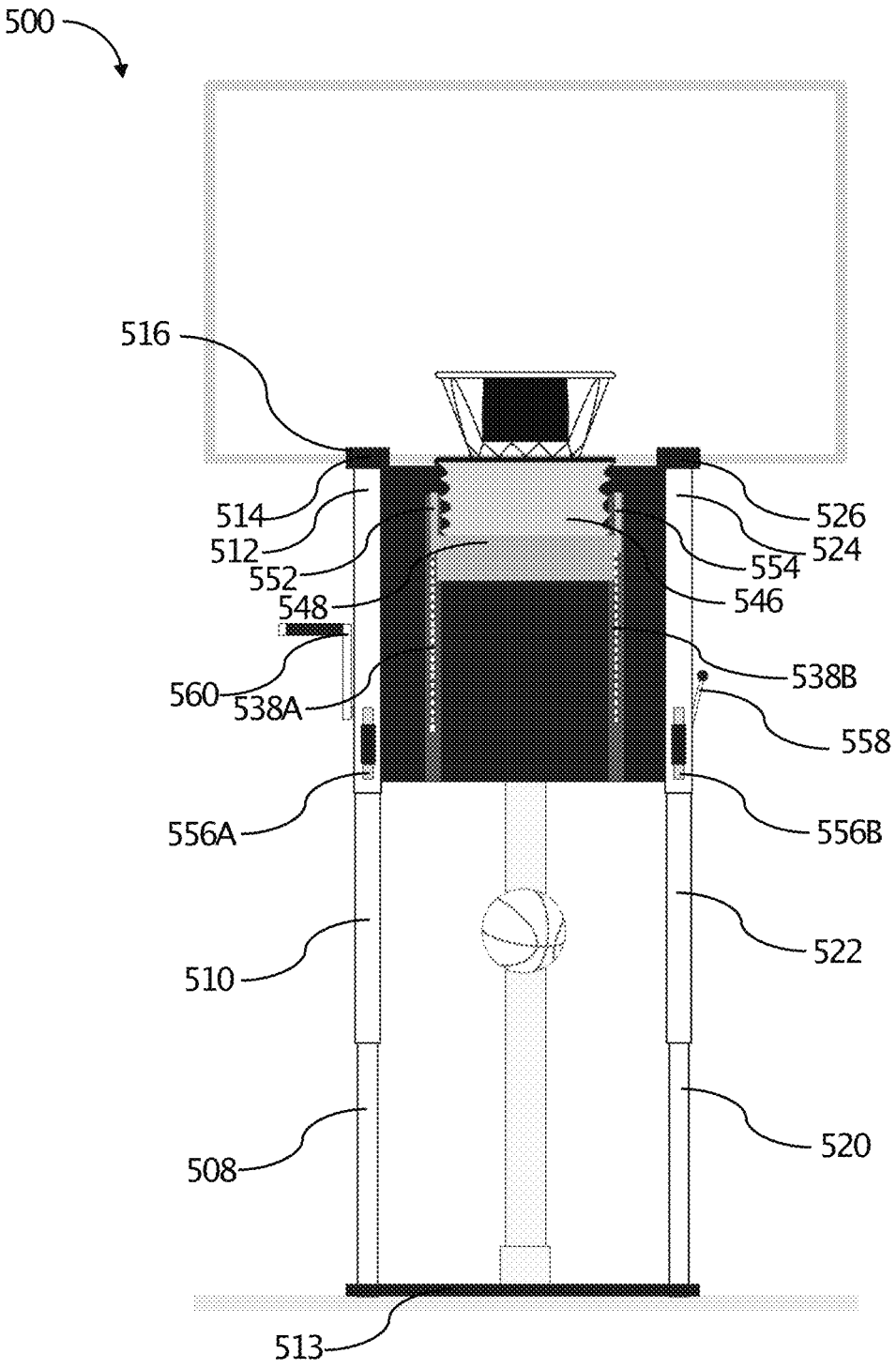
FIG. 23 illustrates a front elevation view of a basketball hoop apparatus.

As illustrated in FIGS. 21-23, to raise and lower the first and second legs 502, 504, the basketball apparatus 500 may comprise a first handle 556A on the first leg 502 (the third shaft), a second handle 556B on the second leg 504 (the sixth shaft), and ratchet lever 558. Accordingly, a user may grab the first and second handles 556A, 556B, while standing on the base plate 513, and lift upward, extending the first and second legs 502, 504, until the first and second brackets 514, 526 are positioned around the lower surface of the backboard 520. The basketball apparatus 500 may comprise a series of click-ratchets that will hold the first and second legs 502, 504 in a first, extended position. To further secure the first and second brackets 514, 526 against the backboard 520, the user may utilize the ratchet lever 558, which will further raise the basketball apparatus 500, thereby increasing securement of the first and second brackets 514, 526 with the backboard 520. In order to lower the first and second legs 502, 504 to a second, lowered position, the user may grab the first and second handles 556A, 556B and pull them inward, toward the body, allowing the series of ratchets to disengage and allowing a controlled descent. Other mechanisms to raise or lower the basketball apparatus 500 may be used without departing herefrom.

Figure 24:
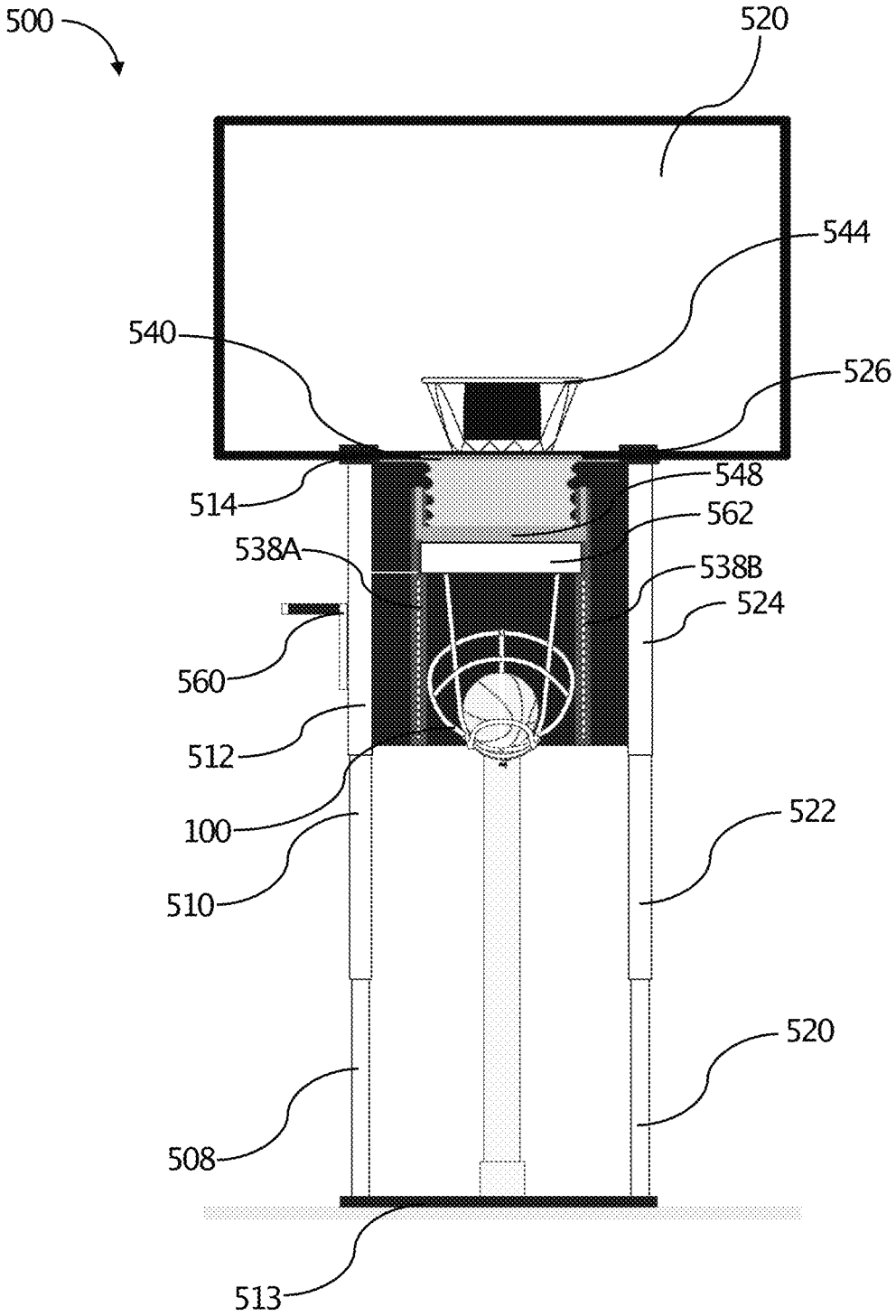
FIG. 24 illustrates a front elevation view of a basketball hoop apparatus.
Figure 25:
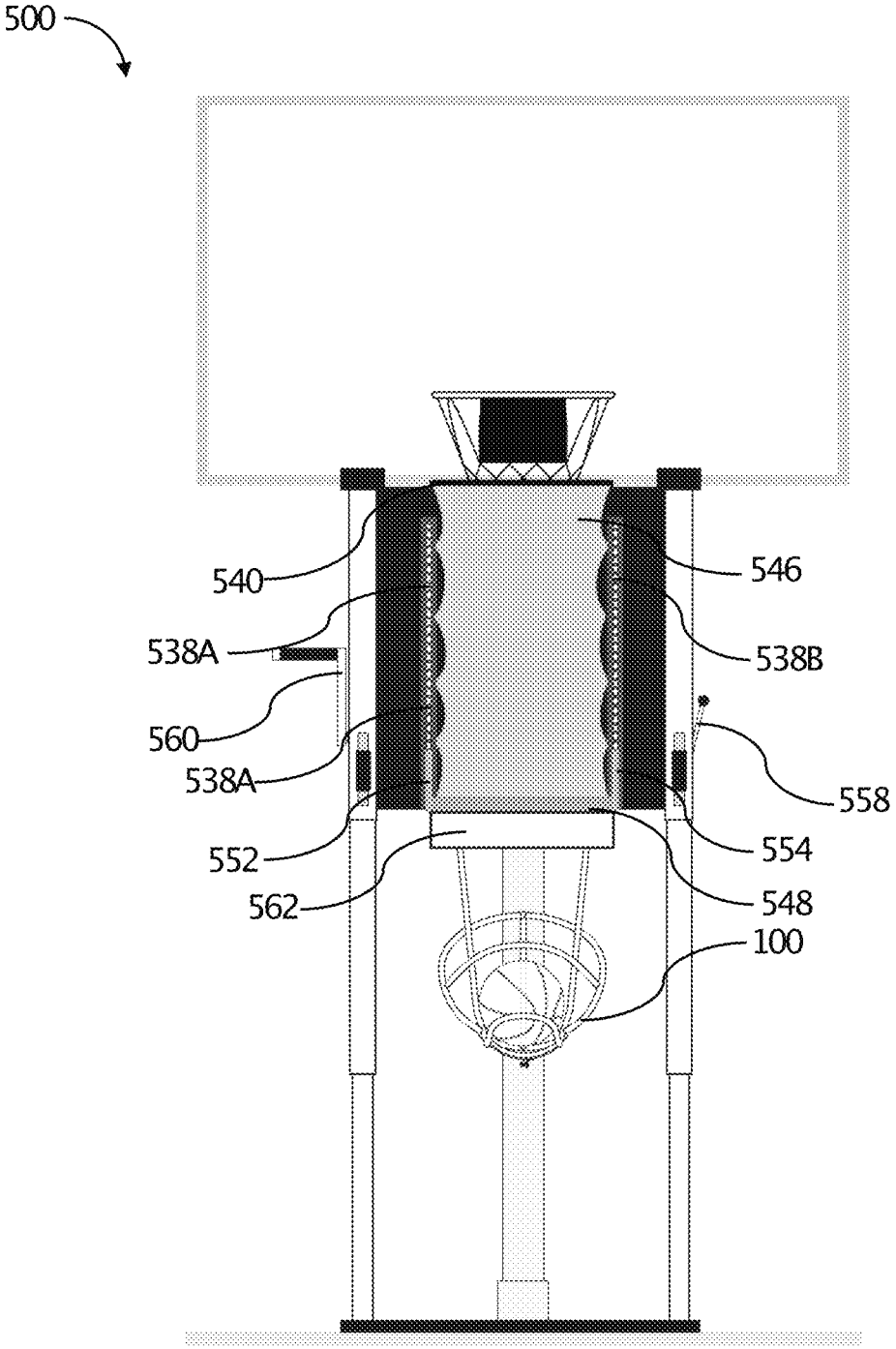
FIG. 25 illustrates a front elevation view of a basketball hoop apparatus.

As illustrated in FIGS. 24-25, when the basketball apparatus 500 is in the first extended position, a user may raise or lower the secondary basketball rim 548 and track bracket 550 by rotating a crank handle 560. This allows the track bracket 550 to raise or lower to a user's desired height, which extends or compresses the collapsible tube 546.

Figure 26:
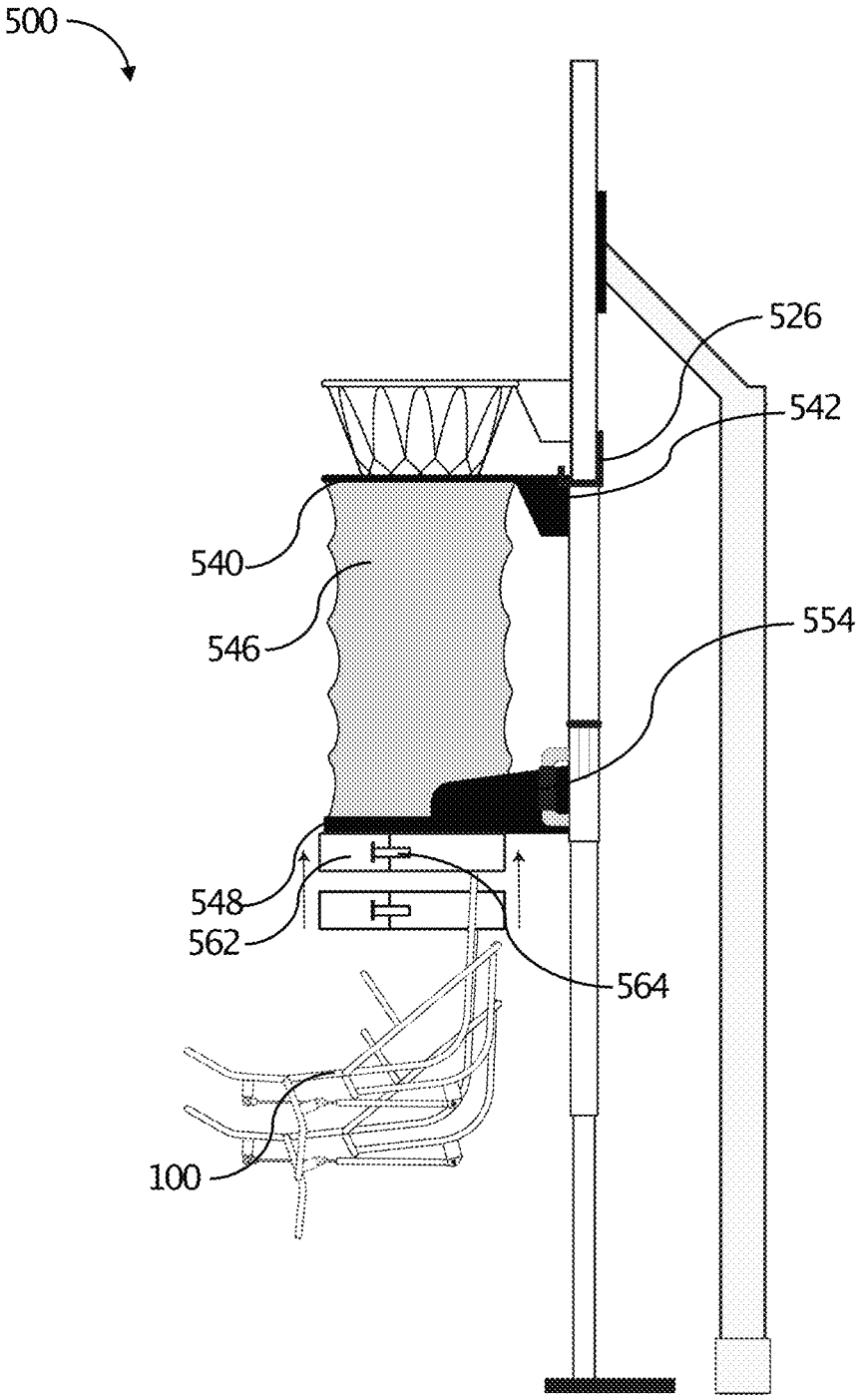
FIG. 26 illustrates a side elevation view of a basketball hoop apparatus.
Figure 27:
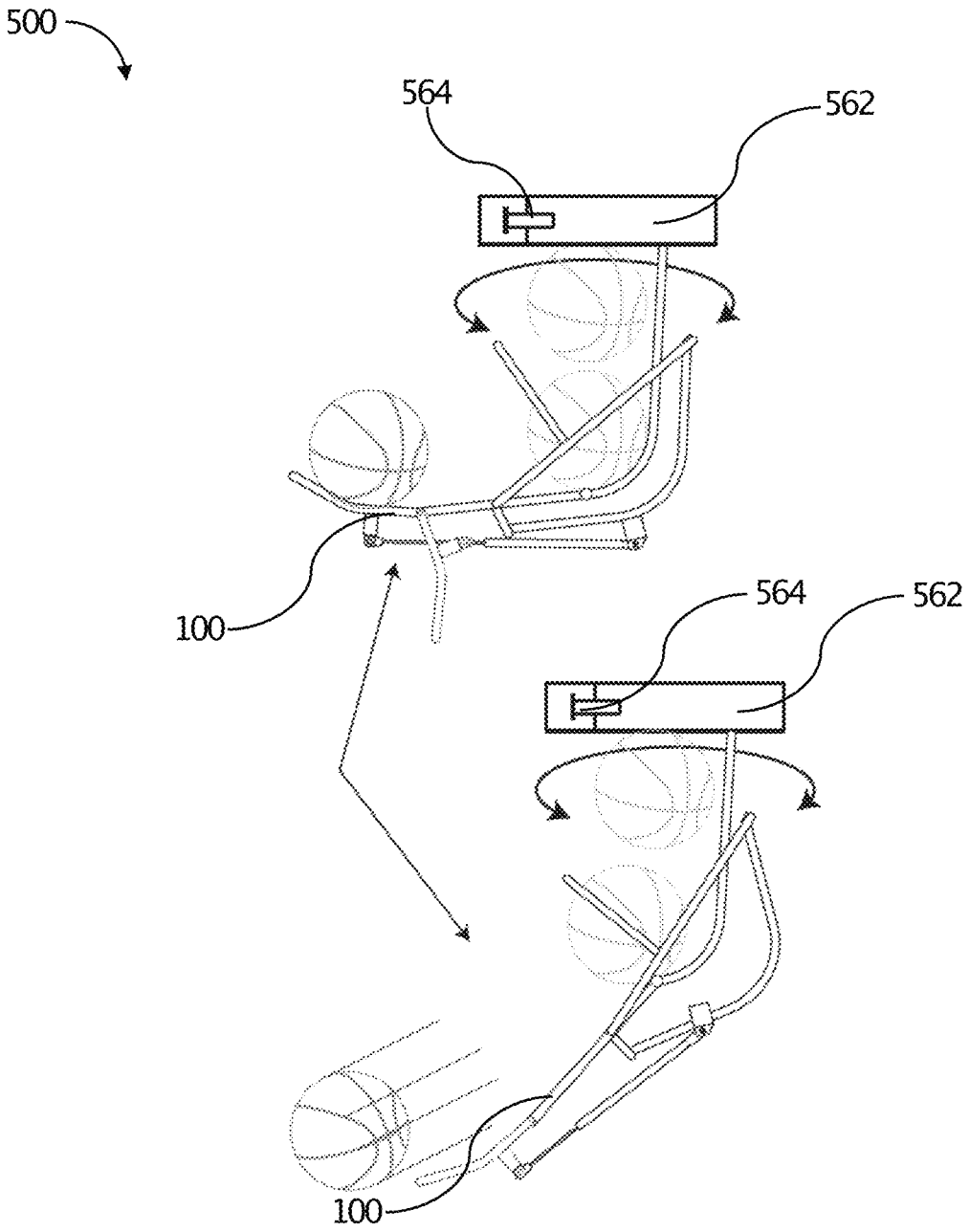
FIG. 27 illustrates a side elevation view of a basketball rebounding apparatus.

As shown in at least FIG. 26, in some embodiments, the secondary basketball rim 548 may receive a removably attachable sleeve 562 that has a latch 564. The sleeve 562 may be configured to allow the secondary basketball rim 548 to receive and secure the basketball rebounding apparatus 100. It will be appreciated that the basketball rebounding apparatus 100 may be able to turn, for example, 180 degrees due to the sleeve 562 so as to allow a user to rebound from different angles. Furthermore, as shown in FIG. 27, when using the sleeve 562, the user may be able to configure basketball rebounding apparatus 100 at various angles of tilt, such as 45 degrees or more, that will allow the basketball rebounding apparatus 100 to act as a gravity fed ball return for shooting practice.

Figure 28:
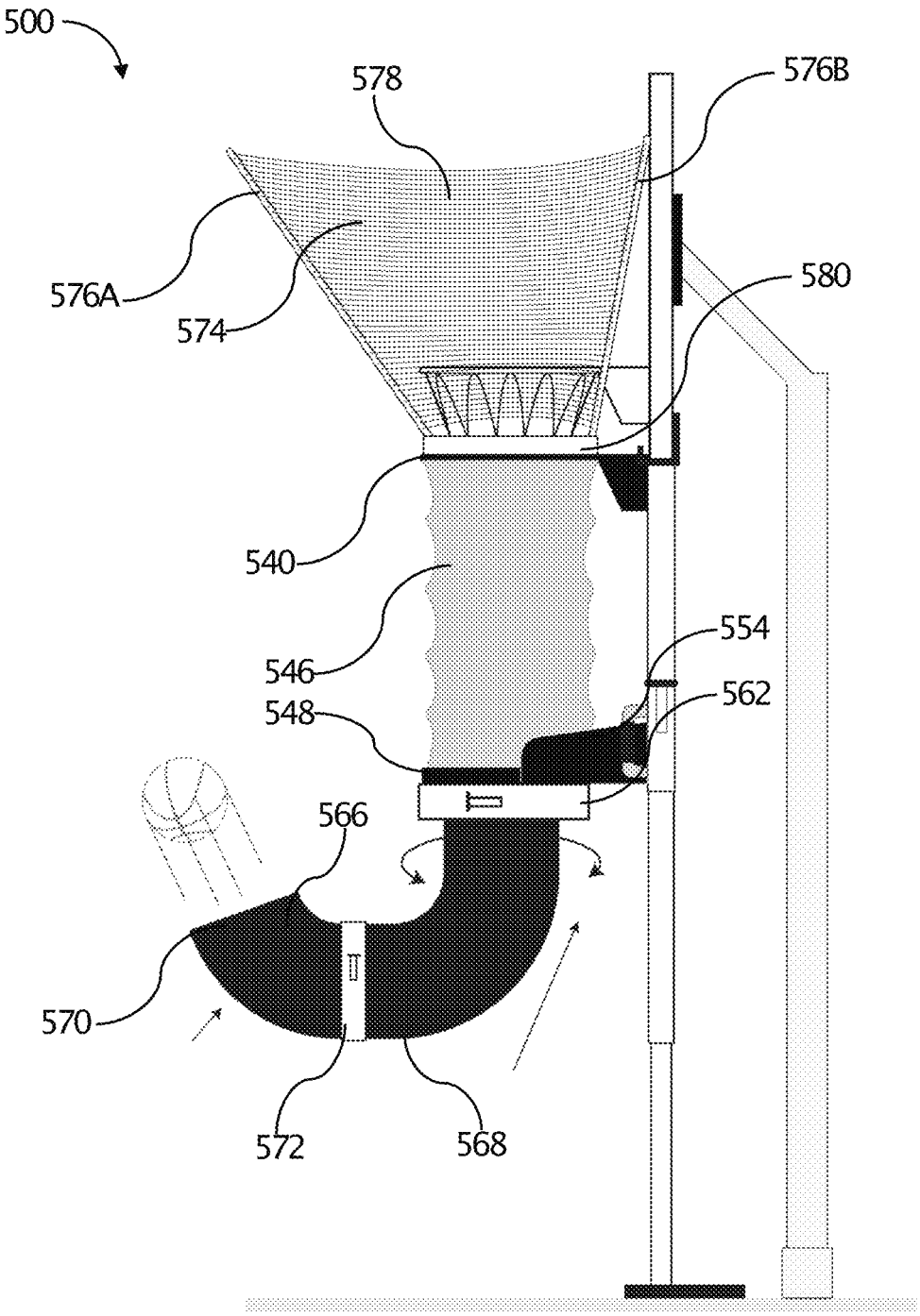
FIG. 28 illustrates a side elevation view of a basketball hoop apparatus.
Figure 29:
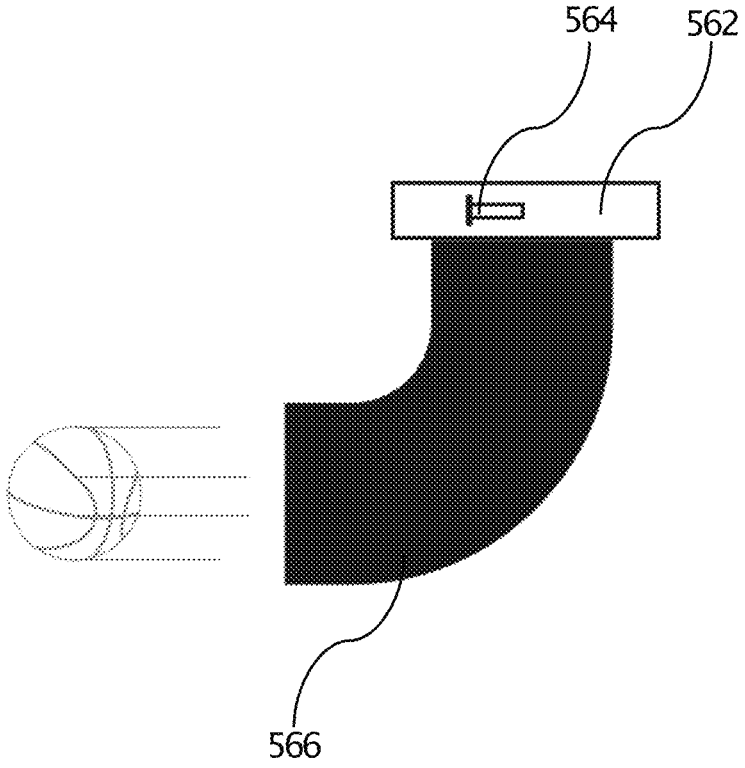
FIG. 29 illustrates a side elevation view of a basketball shooting apparatus.

As illustrated in FIGS. 28-29, in some embodiments, a ball shooting device 566 may replace the basketball rebounding apparatus 100 on the secondary rim 548, more particularly, in the sleeve 562. Accordingly, the ball shooting device 566 may couple to the secondary rim 548 via the sleeve 562. The ball shooting device 566 may comprise a first section 568 and a second section 570 coupled to each other via a second sleeve 572 (e.g., clamp). It will be appreciated that the ball shooting device 566, in some embodiments, may include one or more sections at various lengths, widths, angles, etc. The ball shooting device 566 may launch basketballs to a shooter after a shooter shoots a basketball into the basketball hoop. Accordingly, the user may be at various locations and various distances on the court and still receive the launched basketballs. The ball shooting device 566 may comprise a motor, rollers, etc. that facilitate movement of the basketball.

Further, in some embodiments, a net apparatus 574 may be placed, for example, on the basketball apparatus 400 or other basketball hoops to receive and funnel missed shots to the basketball rebounding apparatus 100 or the shooting device 566, for example. The net apparatus 574 may comprise a plurality of arms 576A, 576B and a net 578 that wraps therearound. The primary basketball rim 540 may receive a third sleeve 580, similar to the second sleeve 572, which is configured to receive the net apparatus 574.

It will be understood that while various embodiments have been disclosed herein, other embodiments are contemplated. Further, certain embodiments of the present disclosure may include, incorporate, or otherwise comprise properties or features described in other embodiments. Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure.

The embodiments described herein are examples of the present disclosure. Accordingly, unless a feature or component is described as requiring another feature or component in combination therewith, any feature herein may be combined with any other feature of a same or different embodiment disclosed herein. Although only a few of the example embodiments have been described in detail herein, those skilled in the art will appreciate that modifications are possible without materially departing from the present disclosure described herein. Accordingly, all modifications may be included within the scope of this invention.

What is claimed is:

1. A basketball rebounding system comprising:

an adjustable basketball hoop comprising:

a back panel comprising a first bracket and a second bracket;

a rim coupled to the back panel;

a first leg coupled to the first bracket;

a second leg coupled to the second bracket;

a crank actuator that interacts with the first leg and the second leg, wherein the crank actuator allows the back panel and the rim to ascend and descend;

a basketball rebounding apparatus removably attachable to the adjustable basketball hoop, the basketball rebounding apparatus comprising:

a first frame comprising a removably attachable first arm and a removably attachable second arm;

a plurality of first fasteners removably attachable to the first frame;

a second frame hingedly coupled to the first arm and the second arm at an end opposite the first frame;

a support member positioned on and coupled to a lower surface of the second frame, the second frame, when in a first position, holds a basketball.

2. The basketball rebounding system of claim 1, wherein the rim comprises a rim bracket that hingedly couples the rim to the back panel.

3. The basketball rebounding system of claim 1, wherein the first leg comprises a first shaft that is positionable into a second, larger shaft and the first and second shafts positionable into a third shaft that is larger in diameter than both the first and second shafts.

4. The basketball rebounding system of claim 1, wherein the second leg comprises a fourth shaft positionable into a fifth, larger shaft and the fourth and fifth shafts positionable into a sixth shaft that is larger in diameter than both the fourth and fifth shafts.

5. The basketball rebounding system of claim 1, further comprising a first rod that couples the first leg to the first bracket.

6. The basketball rebounding system of claim 1, further comprising a second rod that couples to a second bracket.

7. The basketball rebounding system of claim 3, wherein the third shaft comprises a first section hingedly coupled to a second section.

8. The basketball rebounding system of claim 4, wherein the sixth shaft comprises a third section hingedly coupled to a fourth section.

9. The basketball rebounding system of claim 1, wherein the adjustable basketball hoop comprises a housing where the first and second legs extend into and are secured.

10. The basketball rebounding system of claim 1, further comprising a first support member and a second support member that couple to the first leg and the second leg, respectively, to hold the first leg and the second legs in an upright, vertical position.

11. The basketball rebounding system of claim 9, wherein the adjustable basketball hoop collapses and is placed in the housing for transport.

12. The basketball rebounding system of claim 1, wherein the basketball rebounding apparatus comprises a cage that retains the basketball in the basketball rebounding apparatus.

13. The basketball rebounding system of claim 1, wherein the plurality of first fasteners each comprise, at a first end, a first finger, a second finger, and a channel interposed between the first and second fingers, the channel receives a rim of a basketball hoop.

14. The basketball rebounding system of claim 12, wherein the cage comprises a first cage member, a second cage member, a third cage member, and a fourth cage member.

15. The basketball rebounding system of claim 14, wherein the first cage member couples to a rear side of the first and second arms.

16. The basketball rebounding system of claim 14, wherein the second cage member is coupled to the first cage member.

17. The basketball rebounding system of claim 14, wherein the fourth cage member comprises a second bracket, the second bracket having a second bracket aperture and a second bracket fastener.

18. The basketball rebounding system of claim 1, wherein the basketball rebounding apparatus receives an actuator that couples to and actuates the second frame.

19. The basketball rebounding system of claim 18, wherein the actuator comprises a pneumatic spring.

20. A basketball rebounding system comprising:

an adjustable basketball hoop comprising:

a back panel comprising a first bracket and a second bracket;

a rim coupled to the back panel;

a first leg coupled to the first bracket at a first end, and the first leg coupled to a first base at a second end opposite the first end, the first base having a first track that allows the first leg to slide along the first base;

a second leg coupled to the second bracket at a third end, and the second leg coupled to a second base at a fourth end opposite the third end, the second base having a second track that allows the second leg to slide along the second base;

a crank actuator that interacts with the first leg and the second leg, wherein the crank actuator allows the back panel and the rim to ascend and descend; and a housing with one or more wheels;

a basketball rebounding apparatus removably attachable to the rim of the adjustable basketball hoop, the basketball rebounding apparatus comprising:

a first frame comprising a removably attachable first arm and a removably attachable second arm, the first frame coupleable to the rim;

a second frame hingedly coupled to the first arm and the second arm at an end opposite the first frame;

a support member positioned on and coupled to a lower surface of the second frame, the second frame, when in a first position, holds a basketball.

* * * * *